US008512519B2

(12) United States Patent
Gupta et al.

(10) Patent No.: US 8,512,519 B2
(45) Date of Patent: Aug. 20, 2013

(54) SULFOPOLYESTERS FOR PAPER STRENGTH AND PROCESS

(75) Inventors: Rakesh Kumar Gupta, Kingsport, TN (US); Daniel William Klosiewicz, Kingsport, TN (US); Melvin Glenn Mitchell, Penrose, NC (US); Marvin Lynn Mitchell, Parker, CO (US)

(73) Assignee: Eastman Chemical Company, Kingsport, TN (US)

( * ) Notice: Subject to any disclaimer, the term of this patent is extended or adjusted under 35 U.S.C. 154(b) by 150 days.

(21) Appl. No.: 12/765,461

(22) Filed: Apr. 22, 2010

(65) Prior Publication Data

US 2010/0269995 A1 Oct. 28, 2010

Related U.S. Application Data

(60) Provisional application No. 61/172,257, filed on Apr. 24, 2009.

(51) Int. Cl.

| | |
|---|---|
| ***D21H 13/00*** | (2006.01) |
| ***D21H 13/02*** | (2006.01) |
| ***D21H 13/40*** | (2006.01) |
| ***D21H 17/29*** | (2006.01) |
| ***D21H 17/58*** | (2006.01) |

(52) U.S. Cl.

USPC ..... 162/148; 162/146; 162/156; 162/157.1; 162/158; 162/164.5; 162/168.2; 162/168.3; 162/175; 528/295; 528/301; 528/308; 528/308.6

(58) Field of Classification Search

USPC ..... 162/141, 146, 147, 148, 156–157.7, 162/158, 164.1, 164.5, 164.6, 164.7, 166, 162/168.1, 168.2, 168.3, 168.7, 175; 528/295, 528/300, 301, 302, 308, 308.6

See application file for complete search history.

(56) References Cited

U.S. PATENT DOCUMENTS

| | | | | |
|---|---|---|---|---|
| 1,814,155 | A | | 7/1931 | Haughey |
| 2,862,251 | A | | 12/1958 | Kalwaites |
| 2,999,788 | A | | 9/1961 | Morgan |
| 3,018,272 | A | | 1/1962 | Griffing et al. |
| 3,033,822 | A | | 5/1962 | Kibler et al. |
| 3,049,469 | A | | 8/1962 | Davison et al. |
| 3,075,952 | A | | 1/1963 | Coover et al. |
| 3,372,084 | A | | 3/1968 | Hanns |
| 3,485,706 | A | | 12/1969 | Evans |
| 3,528,947 | A | | 9/1970 | Lappin et al. |
| 3,556,932 | A | * | 1/1971 | Coscia et al. ..... 162/166 |
| 3,592,796 | A | | 7/1971 | Trapasso et al. |
| 3,772,076 | A | | 11/1973 | Keim |
| 3,779,993 | A | * | 12/1973 | Kibler et al. ..... 528/295 |
| 3,783,093 | A | | 1/1974 | Gallacher et al. |
| 3,803,210 | A | | 4/1974 | Rod et al. |
| 3,833,457 | A | | 9/1974 | Misumi et al. |
| 3,846,507 | A | | 11/1974 | Thomm et al. |
| 3,998,740 | A | | 12/1976 | Bost et al. |
| 4,008,344 | A | | 2/1977 | Okamoto et al. |
| 4,073,777 | A | | 2/1978 | O'Neill et al. |
| 4,073,988 | A | | 2/1978 | Nishida et al. |
| 4,100,324 | A | | 7/1978 | Anderson et al. |
| 4,104,262 | A | | 8/1978 | Schade |
| 4,121,966 | A | | 10/1978 | Amano et al. |
| 4,127,696 | A | | 11/1978 | Okamoto |
| 4,137,393 | A | | 1/1979 | Sidebotham et al. |
| 4,145,469 | A | | 3/1979 | Newkirk et al. |
| 4,233,355 | A | | 11/1980 | Sato et al. |
| 4,234,652 | A | | 11/1980 | Vanoni et al. |
| 4,239,720 | A | | 12/1980 | Gerlach et al. |
| 4,240,918 | A | | 12/1980 | Lagasse et al. |
| 4,243,480 | A | | 1/1981 | Hernandez et al. |
| 4,288,503 | A | | 9/1981 | Goldberg |
| 4,297,412 | A | | 10/1981 | Achard et al. |
| 4,299,654 | A | | 11/1981 | Tlach et al. |
| 4,302,495 | A | | 11/1981 | Marra |
| 4,304,901 | A | | 12/1981 | O'Neill et al. |
| 4,342,801 | A | | 8/1982 | Gerlach et al. |
| 4,350,006 | A | | 9/1982 | Okamoto et al. |
| 4,365,041 | A | | 12/1982 | Okamoto et al. |
| 4,381,335 | A | | 4/1983 | Okamoto |
| 4,410,579 | A | | 10/1983 | Johns |
| 4,427,557 | A | | 1/1984 | Stockburger |

(Continued)

FOREIGN PATENT DOCUMENTS

| | | |
|---|---|---|
| CA | 1290517 | 10/1991 |
| EP | 0340763 A1 | 11/1989 |

(Continued)

OTHER PUBLICATIONS

"Choosing the Proper Short Cut Fiber", technical data sheet, MiniFibers, Inc., [online] pp. 1-2, 2006, [retrieved on Feb. 15, 2006], Retrieved from the Internet: <URL: Htts://www.minifibers,com/Literature/choosing_fiber.htm>.*

PCT International Search Report dated Feb. 4, 2008 for International Application No. PCT/US2007/001082.

U.S. Appl. No. 08/550,042, filed Oct. 30, 1995, Michael C. Cook.

PCT International Search Report dated Nov. 6, 2008 for International Application No. PCT/US2007/025661.

PCT International Search Report dated Jul. 26, 2007 for International Application No. PCT/US2007/001083.

U.S. Appl. No. 61/172,257, filed Apr. 24, 2009, Rakesh Kumar Gupta, et al.

Lyondall Filtration and Separation; "Nonwoven Liquid Filtration Media Construction and Performance"; Accessed from the web: http://www.lydallfiltation.com/tech/documents/Nonwovenliquidfiltration.pdf.

PCT International Search Report dated Jul. 3, 2009 for International Application No. PCT/US2009/001717.

DIN STD 54900 (in German, no English translation available).

ASTM D6340-98.

(Continued)

*Primary Examiner* — Mark Halpern

*Assistant Examiner* — Dennis Cordray

(74) *Attorney, Agent, or Firm* — Polly C. Owen; Tammye L. Taylor

(57) ABSTRACT

Sulfopolyester thermoplastic resins provide advantages in papermaking processes and in paper products including paperboard. Improvements in wet strength and dry strength of paper products are achieved by addition of sulfopolyester thermoplastic resins and cationic strength additives during the paper making process. The use of sulfopolyester thermoplastic resins in paper products also significantly enhances the repulpability of the paper.

21 Claims, No Drawings

(56) References Cited

U.S. PATENT DOCUMENTS 4,460,649 A 7/1984 Park et al.
4,480,085 A 10/1984 Larson
4,496,619 A 1/1985 Okamoto
4,517,715 A 5/1985 Yoshida et al.
4,569,343 A 2/1986 Kimura et al.
4,618,524 A 10/1986 Groitzsch et al.
4,647,497 A 3/1987 Weeks
4,699,845 A 10/1987 Oikawa et al.
4,738,785 A 4/1988 Langston et al.
4,755,421 A 7/1988 Manning et al.
4,795,668 A 1/1989 Krueger et al.
4,804,719 A 2/1989 Weaver et al.
4,810,775 A 3/1989 Bendix et al.
4,863,785 A 9/1989 Berman et al.
4,873,273 A 10/1989 Allan et al.
4,910,292 A 3/1990 Blount
4,921,899 A 5/1990 Phan et al.
4,940,744 A 7/1990 Tortorici et al.
4,943,477 A 7/1990 Kanamura et al.
4,946,932 A 8/1990 Jenkins
4,966,808 A 10/1990 Kawano
4,973,656 A 11/1990 Blount
4,990,593 A 2/1991 Blount
4,996,252 A 2/1991 Phan et al.
5,006,598 A 4/1991 Adams et al.
5,039,339 A 8/1991 Phan et al.
5,057,368 A 10/1991 Largman et al.
5,069,970 A 12/1991 Largman et al.
5,073,436 A 12/1991 Antonacci et al.
5,108,820 A 4/1992 Kaneko et al.
5,124,194 A 6/1992 Kawano
5,158,844 A 10/1992 Hagens et al.
5,162,074 A 11/1992 Hills
5,162,399 A 11/1992 Sharma et al.
5,171,767 A 12/1992 Buckley et al.
5,176,952 A 1/1993 Joseph et al.
5,218,042 A 6/1993 Kuo et al.
5,242,640 A 9/1993 Butler et al.
5,258,220 A 11/1993 Joseph
5,262,460 A 11/1993 Suzuki et al.
5,274,025 A 12/1993 Stockl et al.
5,277,976 A 1/1994 Hogle et al.
5,281,306 A 1/1994 Kakiuchi et al.
5,286,843 A 2/1994 Wood
5,290,626 A 3/1994 Nishioi et al.
5,290,631 A 3/1994 Fleury et al.
5,290,654 A 3/1994 Sacripante et al.
5,292,581 A 3/1994 Viazmensky et al.
5,292,855 A 3/1994 Krutak et al.
5,296,286 A 3/1994 Allen et al.
5,308,697 A 5/1994 Muramoto et al.
5,336,552 A 8/1994 Strack et al.
5,338,406 A 8/1994 Smith
5,342,863 A 8/1994 Buckley et al.
5,366,804 A 11/1994 Dugan
5,368,928 A 11/1994 Okamura et al.
5,369,210 A 11/1994 George et al.
5,369,211 A 11/1994 George et al.
5,374,357 A 12/1994 Comstock et al.
5,375,306 A 12/1994 Roussin-Moynier
5,378,757 A 1/1995 Blount, Jr. et al.
5,382,400 A 1/1995 Pike et al.
5,386,003 A 1/1995 Greene et al.
5,389,068 A 2/1995 Keck
5,395,693 A 3/1995 Cho et al.
5,405,698 A 4/1995 Dugan
5,416,156 A 5/1995 Kamen
5,423,432 A 6/1995 Krutak et al.
5,431,994 A 7/1995 Kozulla
5,446,079 A 8/1995 Buchanan et al.
5,456,982 A 10/1995 Hansen et al.
5,466,410 A 11/1995 Hills
5,466,518 A 11/1995 Isaac et al.
5,472,600 A 12/1995 Ellefson et al.
5,482,772 A 1/1996 Strack et al.
5,486,418 A 1/1996 Ohmory et al.
5,496,627 A 3/1996 Bagrodia et al.
5,498,468 A 3/1996 Blaney
5,502,091 A 3/1996 Dasgupta
5,508,101 A 4/1996 Patnode et al.
5,509,913 A 4/1996 Yeo
5,525,282 A 6/1996 Dugan
5,530,059 A 6/1996 Blount, Jr. et al.
5,536,811 A 7/1996 Wood
5,543,488 A 8/1996 Miller et al.
5,545,481 A 8/1996 Harrington
5,552,495 A 9/1996 Miller et al.
5,559,171 A 9/1996 Buchanan et al.
5,559,205 A 9/1996 Hansen et al.
5,567,510 A 10/1996 Patnode et al.
5,571,620 A 11/1996 George et al.
5,575,918 A 11/1996 Virnig et al.
5,580,911 A 12/1996 Buchanan et al.
5,593,778 A 1/1997 Kondo et al.
5,593,807 A 1/1997 Sacripante et al.
5,599,858 A 2/1997 Buchanan et al.
5,605,746 A 2/1997 Groeger et al.
5,607,491 A 3/1997 Jackson et al.
5,607,765 A 3/1997 Hansen et al.
5,620,785 A 4/1997 Watt et al.
5,630,972 A 5/1997 Patnode et al.
5,635,071 A 6/1997 Al-Samadi
5,637,385 A 6/1997 Mizuki et al.
5,643,662 A 7/1997 Yeo et al.
5,646,237 A 7/1997 George et al.
5,652,048 A 7/1997 Haynes et al.
5,654,086 A 8/1997 Nishijima et al.
5,658,704 A 8/1997 Patel et al.
5,660,965 A 8/1997 Mychajlowskij et al.
5,672,415 A 9/1997 Sawyer et al.
5,688,582 A 11/1997 Nagaoka et al.
5,698,331 A 12/1997 Matsumura et al.
5,709,940 A 1/1998 George et al.
5,736,083 A 4/1998 Dugan
5,750,605 A * 5/1998 Blumenthal et al. ..... 524/230
5,753,351 A 5/1998 Yoshida et al.
5,759,926 A 6/1998 Pike et al.
5,763,065 A 6/1998 Patnode et al.
5,779,736 A 7/1998 Frederick et al.
5,783,503 A 7/1998 Gillespie et al.
5,785,725 A 7/1998 Cusick et al.
5,798,078 A 8/1998 Myers
5,817,740 A 10/1998 Anderson et al.
5,820,982 A 10/1998 Salsman
5,837,658 A 11/1998 Stork
5,843,311 A 12/1998 Richter et al.
5,853,701 A 12/1998 George et al.
5,853,944 A 12/1998 Foucher et al.
5,871,845 A 2/1999 Dahringer et al.
5,883,181 A 3/1999 Cicchiello et al.
5,888,916 A 3/1999 Tadokoro et al.
5,895,710 A 4/1999 Sasse et al.
5,916,678 A 6/1999 Jackson et al.
5,916,687 A 6/1999 Takanashi et al.
5,916,725 A 6/1999 Patel et al.
5,916,935 A 6/1999 Wiggins et al.
5,935,880 A 8/1999 Wang et al.
5,935,883 A 8/1999 Pike
5,935,884 A 8/1999 Williams et al.
5,948,710 A 9/1999 Pomplun et al.
5,952,251 A 9/1999 Jackson et al.
5,954,967 A 9/1999 Egraz et al.
5,970,583 A 10/1999 Groten et al.
5,976,694 A 11/1999 Tsai et al.
5,993,668 A 11/1999 Duan
5,993,834 A 11/1999 Shah et al.
6,004,673 A 12/1999 Nishijima
6,007,910 A 12/1999 Miller et al.
6,020,420 A 2/2000 George
6,037,055 A 3/2000 Aneja et al.
6,057,388 A 5/2000 Wiggins et al.
6,080,471 A 6/2000 Shigematsu et al.
6,090,731 A 7/2000 Pike et al.
6,110,249 A 8/2000 Medcalf et al.

6,110,588 A 8/2000 Perez et al.
6,110,636 A 8/2000 Foucher et al.
6,114,407 A 9/2000 Myers
6,121,170 A 9/2000 Tsai et al.
6,162,340 A 12/2000 Zakikhani
6,162,890 A * 12/2000 George et al. ..... 528/295
6,168,719 B1 1/2001 Shimokawa et al.
6,171,685 B1 1/2001 George et al.
6,174,602 B1 1/2001 Matsui et al.
6,177,193 B1 1/2001 Tsai et al.
6,177,607 B1 1/2001 Blaney et al.
6,183,648 B1 2/2001 Kozak et al.
6,200,669 B1 3/2001 Marmon et al.
6,211,309 B1 4/2001 McIntosh et al.
6,218,321 B1 4/2001 Lorcks et al.
6,225,243 B1 5/2001 Austin
6,235,392 B1 * 5/2001 Luo et al. ..... 428/369
6,248,809 B1 6/2001 Buckley et al.
6,294,645 B1 9/2001 Allen et al.
6,296,933 B1 10/2001 Goda et al.
6,300,306 B1 10/2001 Firkins et al.
6,316,592 B1 11/2001 Bates et al.
6,322,887 B1 11/2001 Matsui et al.
6,331,606 B1 12/2001 Sun
6,332,994 B1 12/2001 Karageorgiou
6,348,679 B1 2/2002 Ryan et al.
6,352,948 B1 3/2002 Pike et al.
6,355,137 B1 3/2002 Staib
6,361,784 B1 3/2002 Brennan et al.
6,365,697 B1 4/2002 Kim et al.
6,369,136 B2 4/2002 Sorriero et al.
6,381,817 B1 5/2002 Moody, III
6,384,108 B1 5/2002 Breton et al.
6,402,870 B1 6/2002 Groten et al.
6,403,677 B1 6/2002 Walker
6,417,251 B1 7/2002 Brady
6,420,024 B1 7/2002 Perez et al.
6,420,027 B2 7/2002 Kimura et al.
6,428,900 B1 8/2002 Wang
6,429,253 B1 * 8/2002 Guerro et al. ..... 524/514
6,430,348 B1 8/2002 Asano et al.
6,432,532 B2 8/2002 Perez et al.
6,432,850 B1 8/2002 Takagi et al.
6,436,855 B1 8/2002 Iwata et al.
6,440,556 B2 8/2002 Matsui et al.
6,441,267 B1 8/2002 Dugan
6,471,910 B1 10/2002 Haggard
6,488,731 B2 12/2002 Schultheiss et al.
6,506,853 B2 1/2003 Duan
6,509,092 B1 1/2003 Dugan
6,512,024 B1 1/2003 Thumma et al.
6,533,938 B1 3/2003 Dilorio et al.
6,541,175 B1 4/2003 Jiang et al.
6,548,592 B1 4/2003 Lang et al.
6,550,622 B2 4/2003 Koslow
6,551,353 B1 4/2003 Baker et al.
6,552,123 B1 4/2003 Katayama et al.
6,552,162 B1 4/2003 Wang et al.
6,554,881 B1 4/2003 Healey
6,573,204 B1 6/2003 Philipp et al.
6,576,716 B1 6/2003 Wo
6,579,466 B1 6/2003 David et al.
6,583,075 B1 6/2003 Dugan
6,586,529 B2 7/2003 Mumick et al.
6,589,426 B1 7/2003 Husain et al.
6,602,955 B2 8/2003 Soerens et al.
H2086 H 10/2003 Amsler
6,638,677 B2 10/2003 Patel et al.
6,657,017 B2 12/2003 Wo et al.
6,664,437 B2 12/2003 Sawyer et al.
6,692,825 B2 2/2004 Qin et al.
6,706,652 B2 3/2004 Groten et al.
6,720,063 B2 4/2004 Kobayashi et al.
6,730,387 B2 5/2004 Rezai et al.
6,743,506 B2 6/2004 Bond et al.
6,746,766 B2 6/2004 Bond et al.
6,746,779 B2 6/2004 Hayes et al.
6,759,124 B2 7/2004 Royer et al.
6,764,802 B2 7/2004 Maric
6,767,498 B1 7/2004 Talley, Jr. et al.
6,776,858 B2 8/2004 Bansal et al.
6,780,560 B2 8/2004 Farrugia et al.
6,780,942 B2 8/2004 Leon et al.
6,787,245 B1 * 9/2004 Hayes ..... 428/480
6,815,382 B1 11/2004 Groten et al.
6,838,172 B2 1/2005 Yoon et al.
6,838,403 B2 1/2005 Tsai et al.
6,841,038 B2 * 1/2005 Horenziak et al. ..... 162/129
6,844,062 B2 1/2005 Matsui et al.
6,844,063 B2 1/2005 Matsui et al.
6,849,329 B2 2/2005 Perez et al.
6,855,422 B2 2/2005 Magill et al.
6,860,906 B2 3/2005 Malisz et al.
6,861,142 B1 3/2005 Wilkie et al.
6,890,649 B2 5/2005 Hobbs et al.
6,893,711 B2 5/2005 Williamson et al.
6,900,148 B2 5/2005 Yoneda et al.
6,902,796 B2 6/2005 Morell et al.
6,946,506 B2 9/2005 Bond et al.
6,949,288 B2 9/2005 Hodge et al.
6,953,622 B2 10/2005 Tsai et al.
6,989,194 B2 1/2006 Bansal et al.
7,008,485 B2 3/2006 Heikkila et al.
7,011,653 B2 3/2006 Imsangjan et al.
7,011,885 B2 3/2006 Chang et al.
7,014,803 B2 3/2006 Perez et al.
7,022,201 B2 4/2006 Anderson et al.
7,025,885 B2 4/2006 Cote et al.
7,026,033 B2 4/2006 Fujimori et al.
7,070,695 B2 7/2006 Husain et al.
7,087,301 B2 8/2006 Musgrave et al.
7,091,140 B1 8/2006 Ferencz et al.
7,097,904 B2 8/2006 Ochi et al.
7,144,614 B2 12/2006 Nakajima et al.
7,160,612 B2 1/2007 Magill et al.
7,163,744 B2 1/2007 Nightingale et al.
7,166,225 B2 1/2007 Pitt et al.
7,179,376 B2 2/2007 Kaleem et al.
7,186,343 B2 3/2007 Rabie et al.
7,186,344 B2 3/2007 Hughes
7,193,029 B2 3/2007 Hayes
7,194,788 B2 3/2007 Clark et al.
7,195,814 B2 3/2007 Ista et al.
7,214,765 B2 5/2007 Ringeisen et al.
7,220,815 B2 5/2007 Hayes
7,238,415 B2 7/2007 Rodriguez et al.
7,238,423 B2 7/2007 Calhoun et al.
7,241,497 B2 7/2007 Magill et al.
7,276,139 B2 10/2007 Katai et al.
7,285,209 B2 10/2007 Yu et al.
7,291,270 B2 11/2007 Gibson et al.
7,291,389 B1 11/2007 Bitler et al.
7,304,125 B2 12/2007 Ibar
7,306,735 B2 12/2007 Baggott et al.
7,309,372 B2 12/2007 Kahlbaugh et al.
7,314,497 B2 1/2008 Kahlbaugh et al.
7,329,723 B2 2/2008 Jernigan et al.
7,338,664 B2 3/2008 Tseng et al.
7,344,775 B2 3/2008 Stevens et al.
7,347,947 B2 3/2008 Nakamura et al.
7,357,985 B2 4/2008 Kurian et al.
7,358,022 B2 4/2008 Farrugia et al.
7,358,323 B2 4/2008 Maeda et al.
7,358,325 B2 4/2008 Hayes
7,361,700 B2 4/2008 Sunamori et al.
7,365,118 B2 4/2008 McCleskey et al.
7,371,701 B2 5/2008 Inagaki
7,387,976 B2 6/2008 Baba et al.
7,388,058 B2 6/2008 Kaku et al.
7,405,171 B2 7/2008 Tsujiyama et al.
7,405,266 B2 7/2008 Bentley et al.
7,432,219 B2 10/2008 Strandqvist et al.
7,442,277 B2 10/2008 Kupper et al.
7,462,386 B2 12/2008 Yamasaki et al.
7,497,895 B2 3/2009 Sabottke
7,513,004 B2 4/2009 Luckman et al.
7,560,159 B2 7/2009 Goda et al.
7,576,019 B2 8/2009 Bond et al.

7,588,688 B2 9/2009 Butters et al.
7,622,188 B2 11/2009 Kamiyama et al.
7,635,745 B2 12/2009 Gupta
7,655,070 B1 2/2010 Dallas et al.
7,666,500 B2 2/2010 Magill et al.
7,666,502 B2 2/2010 Magill et al.
7,666,504 B2 2/2010 Ochi et al.
7,674,510 B2 3/2010 Kamiya
7,687,143 B2 3/2010 Gupta et al.
7,695,812 B2 4/2010 Peng et al.
7,696,111 B2 4/2010 Mangold et al.
7,704,595 B2 4/2010 Morin
7,718,104 B2 5/2010 MacDonald et al.
7,727,627 B2 6/2010 Sen et al.
7,732,557 B2 6/2010 Phelps et al.
7,736,737 B2 6/2010 Van Dun et al.
7,737,060 B2 6/2010 Strickler et al.
7,744,807 B2 6/2010 Berrigan et al.
7,754,123 B2 7/2010 Verdegan et al.
7,757,811 B2 7/2010 Fox et al.
7,765,647 B2 8/2010 Smith et al.
7,772,456 B2 8/2010 Zhang et al.
7,820,568 B2 10/2010 Horiguchi et al.
7,837,814 B2 11/2010 Minami et al.
7,858,732 B2 12/2010 Bruchmann et al.
7,883,604 B2 2/2011 Dyer et al.
7,884,037 B2 2/2011 Sirovatka et al.
7,887,526 B2 2/2011 Van Gompel et al.
7,892,672 B2 2/2011 Nishikawa
7,892,992 B2 2/2011 Kamada et al.
7,892,993 B2 * 2/2011 Gupta et al. ..... 442/363
7,896,940 B2 3/2011 Sundet et al.
7,897,078 B2 3/2011 Petersen et al.
7,897,248 B2 3/2011 Barrera et al.
7,902,094 B2 3/2011 Haile et al.
7,902,096 B2 3/2011 Brandner et al.
7,910,207 B2 3/2011 Kamiyama et al.
7,914,866 B2 3/2011 Shannon et al.
7,918,313 B2 4/2011 Gross et al.
7,919,419 B2 4/2011 Hurley et al.
7,922,959 B2 4/2011 Jones et al.
7,923,143 B2 4/2011 Tanaka et al.
7,928,025 B2 4/2011 Shipley et al.
7,931,457 B2 4/2011 Johnson et al.
7,932,192 B2 4/2011 Fujisawa et al.
7,935,645 B2 5/2011 Pourdeyhimi et al.
7,947,142 B2 5/2011 Fox et al.
7,947,864 B2 5/2011 Damay et al.
7,951,313 B2 5/2011 Matsubayashi et al.
7,951,452 B2 5/2011 Nakayama et al.
7,959,848 B2 6/2011 Reneker et al.
8,021,457 B2 9/2011 Dema et al.
8,057,567 B2 11/2011 Webb et al.
8,129,019 B2 3/2012 Pourdeyhimi et al.
2002/0009590 A1 1/2002 Matsui et al.
2002/0030016 A1 3/2002 Schmidt
2002/0079121 A1 6/2002 Ryan et al.
2002/0106510 A1 8/2002 Deguchi et al.
2002/0123290 A1 9/2002 Tsai et al.
2002/0127937 A1 9/2002 Lange et al.
2002/0127939 A1 9/2002 Hwo et al.
2002/0146552 A1 10/2002 Mumick et al.
2002/0187329 A1 12/2002 Ista et al.
2003/0026986 A1 2/2003 Matsui et al.
2003/0057155 A1 3/2003 Husain et al.
2003/0077444 A1 4/2003 Bond et al.
2003/0091822 A1 5/2003 Bond et al.
2003/0092343 A1 5/2003 Bond et al.
2003/0104204 A1 6/2003 Bond et al.
2003/0111763 A1 6/2003 Jen
2003/0166370 A1 9/2003 Harris et al.
2003/0166371 A1 9/2003 Fingal et al.
2003/0168191 A1 9/2003 Hansen et al.
2003/0176132 A1 9/2003 Moriyasu et al.
2003/0194558 A1 10/2003 Anderson
2003/0196955 A1 10/2003 Hughes
2004/0081829 A1 4/2004 Klier et al.
2004/0157037 A1 8/2004 Yamaguchi et al.
2004/0194558 A1 10/2004 Nagase
2004/0209058 A1 10/2004 Chou et al.
2004/0211729 A1 10/2004 Sunkara et al.
2004/0242106 A1 12/2004 Rabasco et al.
2004/0242838 A1 12/2004 Duan
2004/0258910 A1 12/2004 Haile et al.
2004/0260034 A1 12/2004 Haile et al.
2005/0026527 A1 2/2005 Schmidt
2005/0027098 A1 2/2005 Hayes
2005/0032450 A1 2/2005 Haggard et al.
2005/0079781 A1 4/2005 Tsujimoto et al.
2005/0115902 A1 6/2005 Kaleem et al.
2005/0125908 A1 6/2005 Pourdeyhimi
2005/0148261 A1 7/2005 Close et al.
2005/0171250 A1 8/2005 Hayes
2005/0208300 A1 9/2005 Magill et al.
2005/0221709 A1 10/2005 Jordan et al.
2005/0222956 A1 10/2005 Bristow et al.
2005/0227068 A1 10/2005 Dugan
2005/0239359 A1 10/2005 Jones et al.
2005/0282008 A1 12/2005 Haile et al.
2005/0287895 A1 12/2005 Bansal
2006/0011544 A1 1/2006 Sharma et al.
2006/0019570 A1 1/2006 Groten et al.
2006/0021938 A1 2/2006 Diallo
2006/0030230 A1 2/2006 Nagaoka et al.
2006/0035556 A1 2/2006 Yokoi et al.
2006/0049386 A1 3/2006 Kody et al.
2006/0051575 A1 3/2006 Yoon et al.
2006/0057350 A1 3/2006 Ochi et al.
2006/0057373 A1 3/2006 Inagaki et al.
2006/0060529 A1 3/2006 Cote et al.
2006/0065600 A1 3/2006 Sunkara et al.
2006/0081330 A1 4/2006 Minami et al.
2006/0083917 A1 4/2006 Dugan
2006/0093814 A1 5/2006 Chang
2006/0093819 A1 5/2006 Atwood et al.
2006/0113033 A1 6/2006 Bruner
2006/0128247 A1 6/2006 Skoog et al.
2006/0135020 A1 6/2006 Weinberg et al.
2006/0147709 A1 7/2006 Mizumura et al.
2006/0155094 A1 7/2006 Meckel et al.
2006/0159918 A1 7/2006 Dugan et al.
2006/0177656 A1 8/2006 Kolmes et al.
2006/0189956 A1 8/2006 Catalan
2006/0194027 A1 8/2006 Pourdeyhimi et al.
2006/0194047 A1 8/2006 Gupta et al.
2006/0204753 A1 9/2006 Simmonds et al.
2006/0210797 A1 9/2006 Masuda et al.
2006/0230731 A1 10/2006 Kalayci et al.
2006/0234049 A1 10/2006 Van Dun et al.
2006/0234050 A1 10/2006 Frankel
2006/0234587 A1 10/2006 Horiguchi et al.
2006/0263601 A1 11/2006 Wang et al.
2006/0281383 A1 12/2006 Schmitt et al.
2007/0009736 A1 1/2007 Chuang et al.
2007/0020453 A1 1/2007 Sen et al.
2007/0021021 A1 1/2007 Verdegan et al.
2007/0031637 A1 2/2007 Anderson
2007/0031668 A1 2/2007 Hietpas et al.
2007/0039889 A1 2/2007 Ashford
2007/0048523 A1 3/2007 Pollet et al.
2007/0056906 A1 3/2007 Kaleem et al.
2007/0062872 A1 3/2007 Parker et al.
2007/0074628 A1 4/2007 Jones et al.
2007/0077427 A1 4/2007 Dugan
2007/0098982 A1 5/2007 Nishida et al.
2007/0102361 A1 5/2007 Kiefer et al.
2007/0110980 A1 5/2007 Shah
2007/0110998 A1 5/2007 Steele et al.
2007/0114177 A1 5/2007 Sabottke
2007/0122613 A1 5/2007 Stevens et al.
2007/0122614 A1 5/2007 Peng et al.
2007/0128404 A1 6/2007 Tung et al.
2007/0167096 A1 7/2007 Scott
2007/0179275 A1 8/2007 Gupta et al.
2007/0182040 A1 8/2007 Suzuki et al.
2007/0190319 A1 8/2007 Kalayci
2007/0232179 A1 10/2007 Polat et al.
2007/0232180 A1 10/2007 Polat et al.

2007/0243377 A1 10/2007 Nishida et al.
2007/0254153 A1 11/2007 Nadkarni et al.
2007/0258935 A1 11/2007 McEntire et al.
2007/0259029 A1 11/2007 McEntire et al.
2007/0259177 A1 11/2007 Gupta et al.
2007/0264520 A1 11/2007 Wood et al.
2007/0278151 A1 12/2007 Musale
2007/0278152 A1 12/2007 Musale
2008/0000836 A1 1/2008 Wang et al.
2008/0003400 A1 1/2008 Tseng
2008/0003905 A1 1/2008 Tseng
2008/0003912 A1 1/2008 Pourdeyhimi et al.
2008/0009574 A1 1/2008 Huenefeld et al.
2008/0009650 A1 1/2008 Sluijmers et al.
2008/0011680 A1 1/2008 Partridge et al.
2008/0038974 A1 2/2008 Eagles
2008/0039540 A1 2/2008 Reitz
2008/0064285 A1 3/2008 Morton et al.
2008/0134652 A1 6/2008 Lim et al.
2008/0160278 A1 7/2008 Cheng et al.
2008/0160856 A1 7/2008 Chen et al.
2008/0160859 A1 7/2008 Gupta et al.
2008/0170982 A1 7/2008 Zhang et al.
2008/0188151 A1 8/2008 Yokoi et al.
2008/0207833 A1* 8/2008 Bear et al. ..... 525/190
2008/0207883 A1 8/2008 Janjic et al.
2008/0229672 A1 9/2008 Woo et al.
2008/0233850 A1 9/2008 Woo et al.
2008/0245037 A1 10/2008 Rogers et al.
2008/0287026 A1 11/2008 Chakravarty et al.
2008/0311815 A1* 12/2008 Gupta et al. ..... 442/351
2009/0025895 A1 1/2009 Cowman
2009/0036015 A1 2/2009 Nhan et al.
2009/0042475 A1 2/2009 Pourdeyhimi et al.
2009/0163449 A1 6/2009 Wempe
2009/0249956 A1 10/2009 Chi et al.
2009/0258182 A1 10/2009 Okamoto et al.
2009/0274862 A1 11/2009 Nakayama et al.
2009/0294435 A1 12/2009 Nhan et al.
2009/0305592 A1 12/2009 Shi et al.
2010/0018660 A1 1/2010 Varnell
2010/0035500 A1 2/2010 Kimura et al.
2010/0072126 A1 3/2010 Tsujimoto et al.
2010/0133173 A1 6/2010 Inagaki
2010/0136312 A1 6/2010 Inagaki
2010/0143717 A1 6/2010 Sakamoto et al.
2010/0173154 A1 7/2010 Shimotsu et al.
2010/0180558 A1 7/2010 Ito et al.
2010/0187712 A1 7/2010 Gupta et al.
2010/0197027 A1 8/2010 Zhang et al.
2010/0200512 A1 8/2010 Chase et al.
2010/0203788 A1 8/2010 Kimura et al.
2010/0247894 A1 9/2010 Beard
2010/0272938 A1 10/2010 Mitchell et al.
2010/0273947 A1 10/2010 Miyauchi et al.
2010/0282682 A1 11/2010 Eaton et al.
2010/0285101 A1 11/2010 Moore et al.
2010/0291213 A1 11/2010 Berrigan et al.
2010/0310921 A1 12/2010 Hayakawa et al.
2011/0020590 A1 1/2011 Yoneda et al.
2011/0030885 A1 2/2011 Anneaux et al.
2011/0033705 A1 2/2011 Komura et al.
2011/0036487 A1 2/2011 Rajala et al.
2011/0039055 A1 2/2011 Fujisawa et al.
2011/0039468 A1 2/2011 Baldwin, Jr. et al.
2011/0040277 A1 2/2011 Rajala et al.
2011/0041471 A1 2/2011 Sebastian et al.
2011/0045042 A1 2/2011 Sasaki et al.
2011/0045231 A1 2/2011 Kajiwara et al.
2011/0045261 A1 2/2011 Sellars
2011/0046461 A1 2/2011 McKenna
2011/0049769 A1 3/2011 Duchoslav et al.
2011/0054429 A1 3/2011 Lademann et al.
2011/0056638 A1 3/2011 Rosset
2011/0059669 A1 3/2011 He et al.
2011/0064928 A1 3/2011 Bonneh
2011/0065573 A1 3/2011 McEneany et al.
2011/0065871 A1 3/2011 Nagano et al.
2011/0067369 A1 3/2011 Chung et al.
2011/0068507 A1 3/2011 Warren et al.
2011/0074060 A1 3/2011 Angadjivand et al.
2011/0076250 A1 3/2011 Belenkaya et al.
2011/0084028 A1 4/2011 Stanfel et al.
2011/0091761 A1 4/2011 Miller et al.
2011/0094515 A1 4/2011 Duffy
2011/0104493 A1 5/2011 Barnholtz et al.
2011/0114274 A1 5/2011 Takano et al.
2011/0117176 A1 5/2011 Klun et al.
2011/0117353 A1 5/2011 Henshaw et al.
2011/0117439 A1 5/2011 Yamada et al.
2011/0123584 A1 5/2011 Seidling et al.
2011/0124769 A1 5/2011 Moen et al.
2011/0124835 A1 5/2011 DeWeijer et al.
2011/0129510 A1 6/2011 Liebmann et al.
2011/0130063 A1 6/2011 Matsubayashi et al.
2011/0142900 A1 6/2011 Ohta et al.
2011/0143110 A1 6/2011 Tsuchiya et al.
2011/0147299 A1 6/2011 Stanfel et al.
2011/0171535 A1 7/2011 Ohinshi et al.
2011/0171890 A1 7/2011 Nakayama et al.
2012/0015577 A1 1/2012 Rudman et al.

FOREIGN PATENT DOCUMENTS

EP 0610894 A1 8/1994
EP 0610897 A1 8/1994
EP 0830466 A1 3/1998
EP 0836656 A1 4/1998
EP 0859073 A1 8/1998
EP 0880909 A1 12/1998
EP 0 666 344 B1 9/1999
EP 1161576 A1 12/2001
EP 1 243 675 A1 9/2002
EP 0 645 480 B1 11/2002
EP 0 961 847 B1 12/2002
EP 1359632 A2 4/2003
EP 0 935 682 B1 9/2003
EP 1 416 077 A2 5/2004
EP 0 905 292 B1 10/2004
EP 1538686 A1 6/2005
EP 1 550 746 A1 7/2005
EP 1 322 802 B1 8/2005
EP 1 314 808 B1 1/2006
EP 1252219 B1 8/2006
EP 1 325 184 B1 9/2006
EP 1 715 089 A2 10/2006
EP 1 319 095 B1 11/2006
EP 1 731 634 A 12/2006
EP 1 149 195 B1 1/2007
EP 1 412 567 B1 1/2007
EP 1 404 905 B1 4/2007
EP 0 842 310 B1 1/2008
EP 1 894 609 A1 3/2008
EP 1 903 134 A1 3/2008
EP 1 938 883 A1 7/2008
EP 2082082 A2 7/2009
EP 1 516 079 B1 12/2009
EP 2 135 984 A1 12/2009
EP 1 224 900 B1 6/2010
EP 2 243 872 A1 10/2010
EP 2283796 A1 2/2011
EP 2287374 A1 2/2011
EP 1 620 506 B1 3/2011
EP 0847263 B2 3/2011
EP 2292309 A1 3/2011
EP 1474555 B1 4/2011
EP 2308579 A1 4/2011
EP 2311542 A1 4/2011
EP 2311543 A1 4/2011
FR 2654674 A1 5/1991
GB 1073640 6/1967
JP 52066719 6/1977
JP 5883046 A 5/1983
JP 58174625 A 10/1983
JP 58220818 12/1983
JP 61047822 3/1986
JP 61-296120 A 12/1986
JP 62078213 4/1987
JP 63-159523 A 7/1988

| | | | |
|---|---|---|---|
| JP | S63227898 | A | 9/1988 |
| JP | 01162825 | A | 6/1989 |
| JP | 1229899 | A | 9/1989 |
| JP | 1-272820 | A | 10/1989 |
| JP | 1289838 | A | 11/1989 |
| JP | 02-026920 | A | 1/1990 |
| JP | 02210092 | A | 8/1990 |
| JP | 316378 | B2 | 3/1991 |
| JP | 3180587 | A | 8/1991 |
| JP | 04057918 | A | 2/1992 |
| JP | 4327209 | A | 11/1992 |
| JP | 518334 | B2 | 3/1993 |
| JP | 1993-263316 | A | 10/1993 |
| JP | 05263316 | | 10/1993 |
| JP | 5321106 | | 12/1993 |
| JP | 6-002221 | A | 1/1994 |
| JP | 6-25396 | A | 2/1994 |
| JP | 9-77963 | A | 3/1997 |
| JP | 9-100397 | A | 4/1997 |
| JP | 9-249742 | A | 9/1997 |
| JP | 09-291472 | | 11/1997 |
| JP | 09-310230 | | 12/1997 |
| JP | 2000-95850 | | 4/2000 |
| JP | 3131100 | B2 | 1/2001 |
| JP | 2001-123335 | | 5/2001 |
| JP | 2003-253555 | A | 9/2003 |
| JP | 2004-137319 | | 5/2004 |
| JP | 2004137418 | A | 5/2004 |
| JP | 2005-002510 | | 1/2005 |
| JP | 2005-154450 | A | 6/2005 |
| JP | 2006233365 | A | 9/2006 |
| JP | 2010255173 | A | 11/2010 |
| JP | 4648815 | B2 | 3/2011 |
| KR | 2001-0044145 | | 6/2001 |
| KR | 531939 | B1 | 11/2005 |
| KR | 2011-031744 | A | 3/2011 |
| KR | 2011-031746 | A | 3/2011 |
| RU | 2414950 | C1 | 3/2011 |
| RU | 2414960 | C1 | 3/2011 |
| TW | 230212 | B | 4/2005 |
| WO | WO 93/07197 | A1 | 4/1993 |
| WO | WO 94/24218 | A | 10/1994 |
| WO | WO 95/03172 | A1 | 2/1995 |
| WO | WO 99/47621 | A1 | 9/1999 |
| WO | WO 99/48668 | | 9/1999 |
| WO | WO 01/66666 | A2 | 9/2001 |
| WO | WO 02/060497 | A2 | 8/2002 |
| WO | WO 03/069038 | A1 | 8/2003 |
| WO | WO 2004/067818 | A2 | 8/2004 |
| WO | WO 2004/099314 | A1 | 11/2004 |
| WO | WO 2004/113598 | A2 | 12/2004 |
| WO | WO 2005/066403 | A1 | 7/2005 |
| WO | WO 2005/103354 | A1 | 11/2005 |
| WO | WO 2005/103357 | A1 | 11/2005 |
| WO | WO 2006/001739 | A1 | 1/2006 |
| WO | WO 2006/052732 | A2 | 5/2006 |
| WO | WO 2006/098851 | A2 | 9/2006 |
| WO | WO 2006/107695 | A2 | 10/2006 |
| WO | WO 2007/089423 | A2 | 8/2007 |
| WO | WO 2007/112443 | A2 | 10/2007 |
| WO | WO 2008/028134 | A1 | 3/2008 |
| WO | WO 2008/085332 | A2 | 7/2008 |
| WO | WO 2009/024836 | A1 | 2/2009 |
| WO | WO 2009/051283 | A1 | 4/2009 |
| WO | WO 2009/076401 | A1 | 6/2009 |
| WO | WO 2009/088564 | A1 | 7/2009 |
| WO | WO 2009/140381 | A1 | 11/2009 |
| WO | WO 2009/152349 | A1 | 12/2009 |
| WO | WO 2010/114820 | A2 | 10/2010 |
| WO | WO 2010/117612 | A2 | 10/2010 |
| WO | WO 2010/123580 | A1 * | 10/2010 |
| WO | WO 2010/125239 | A2 | 11/2010 |
| WO | WO 2010/140853 | A2 | 12/2010 |
| WO | WO 2010/146240 | A2 | 12/2010 |
| WO | WO 2011/015709 | A1 | 2/2011 |
| WO | WO 2011/018459 | A1 | 2/2011 |
| WO | WO 2011/008481 | A3 | 3/2011 |
| WO | WO 2011/027732 | A1 | 3/2011 |
| WO | WO 2011/028661 | A2 | 3/2011 |
| WO | WO 2011/034523 | A1 | 3/2011 |
| WO | WO 2011/047966 | A1 | 4/2011 |
| WO | WO 2011/049831 | A2 | 4/2011 |
| WO | WO 2011/049927 | A2 | 4/2011 |
| WO | WO 2011/052173 | A1 | 5/2011 |
| WO | WO 2011/054932 | A1 | 5/2011 |
| WO | WO 2011/062761 | A1 | 5/2011 |
| WO | WO 2011/063372 | A2 | 5/2011 |
| WO | WO 2011/066224 | A2 | 6/2011 |
| WO | WO 2011/070233 | A1 | 6/2011 |
| WO | 2011104427 | A1 | 9/2011 |
| WO | 2011157892 | A1 | 12/2011 |

OTHER PUBLICATIONS

PCT International Search Report dated Feb. 7, 2005 for International Application No. PCT/US2004/018682.

Smook, G.A., "Handbook for Pulp and Paper Technologist", Angus Wilde Publications, 2nd Ed., 1992, pp. 194-195, 211-212.

PCT International Search Report dated Dec. 30, 2009 for International Application No. PCT/US2007/025770.

Ke Qinfei, et al., "Non-woven Science", Donghau University Press, Sep. 2004, Catalog, p. 115-132 (unavailable).

Copending U.S. Appl. No. 12/909,574, filed Oct. 21, 2010, Rakesh Kumar Gupta, et al.

Copending U.S. Appl. No. 12/966,483, filed Dec. 13, 2010, William Alston Haile, et al.

Copending U.S. Appl. No. 12/966,487, filed Dec. 13, 2010, William Alston Haile, et al.

Copending U.S. Appl. No. 12/966,494, filed Dec. 13, 2010, William Alston Haile, et al.

Copending U.S. Appl. No. 12/966,502, filed Dec. 13, 2010, William Alston Haile, et al.

Copending U.S. Appl. No. 12/966,507, filed Dec. 13, 2010, William Alston Haile, et al.

Copending U.S. Appl. No. 12/966,512, filed Dec. 13, 2010, William Alston Haile, et al.

Copending U.S. Appl. No. 12/966,518, filed Dec. 13, 2010, William Alston Haile, et al.

Copending U.S. Appl. No. 12/966,521, filed Dec. 13, 2010, William Alston Haile, et al.

Copending U.S. Appl. No. 12/975,443, filed Dec. 22, 2010, Rakesh Kumar Gupta, et al.

Copending U.S. Appl. No. 12/975,447, filed Dec. 22, 2010, Rakesh Kumar Gupta, et al.

Copending U.S. Appl. No. 12/975,450, filed Dec. 22, 2010, Rakesh Kumar Gupta, et al.

Copending U.S. Appl. No. 12/975,452, filed Dec. 22, 2010, Rakesh Kumar Gupta, et al.

Copending U.S. Appl. No. 12/975,456, filed Dec. 22, 2010, Rakesh Kumar Gupta, et al.

Copending U.S. Appl. No. 12/975,459, filed Dec. 22, 2010, Rakesh Kumar Gupta, et al.

Copending U.S. Appl. No. 12/975,463, filed Dec. 22, 2010, Rakesh Kumar Gupta, et al.

Copending U.S. Appl. No. 12/975,482, filed Dec. 22, 2010, Rakesh Kumar Gupta, et al.

Copending U.S. Appl. No. 12/975,484, filed Dec. 22, 2010, Rakesh Kumar Gupta, et al.

Copending U.S. Appl. No. 12/975,487, filed Dec. 22, 2010, Rakesh Kumar Gupta, et al.

Copending U.S. Appl. No. 12/981,950, filed Dec. 30, 2010, William Alston Haile, et al.

Copending U.S. Appl. No. 12/981,960, filed Dec. 30, 2010, William Alston Haile, et al.

Copending U.S. Appl. No. 12/981,982, filed Dec. 30, 2010, William Alston Haile, et al.

Copending U.S. Appl. No. 12/982,001, filed Dec. 30, 2010, William Alston Haile, et al.

New copending U.S. Appl. No. 13/053,615, filed Mar. 22, 2011, Rakesh Kumar Gupta et al.

Coons, R., "Eastman Chemical Core Focus Delivers Value," Chemical Week, Aug. 15/22, 2011, pp. 19-22.

USPTO Notice of Allowance dated Dec. 12, 2011 for copending U.S. Appl. No. 12/966,502.

USPTO Notice of Allowance dated Jan. 9, 2012 for copending U.S. Appl. No. 12/975,482.
USPTO Office Action dated Jan. 30, 2012 for copending U.S. Appl. No. 12/975,443.
USPTO Office Action dated Nov. 10, 2011 for copending U.S. Appl. No. 12/975,484.
USPTO Office Action dated Apr. 18, 2012 for copending U.S. Appl. No. 12/975,484.
Copending U.S. Appl. No. 13/273,692, filed Oct. 14, 2011.
Copending U.S. Appl. No. 13/273,648, filed Oct. 14, 2011.
Copending U.S. Appl. No. 13/273,710, filed Oct. 14, 2011.
Copending U.S. Appl. No. 13/273,720, filed Oct. 14, 2011.
Copending U.S. Appl. No. 13/273,929, filed Oct. 14, 2011.
Copending U.S. Appl. No. 13/273,937, filed Oct. 14, 2011.
Copending U.S. Appl. No. 13/273,727, filed Oct. 14, 2011.
Copending U.S. Appl. No. 13/273,737, filed Oct. 14, 2011.
Copending U.S. Appl. No. 13/273,745, filed Oct. 14, 2011.
Copending U.S. Appl. No. 13/273,749, filed Oct. 14, 2011.
Copending U.S. Appl. No. 13/433,812, filed Mar. 29, 2012.
Copending U.S. Appl. No. 13/433,854, filed Mar. 29, 2012.
USPTO Notice of Allowance dated Feb. 7, 2012 for copending U.S. Appl. No. 12/975,459.
USPTO Notice of Allowance dated Feb. 17, 2012 for copending U.S. Appl. No. 12/982,001.
USPTO Notice of Allowance dated Feb. 21, 2012 for copending U.S. Appl. No. 12/975,450.
USPTO Notice of Allowance dated Feb. 23, 2012 for copending U.S.Appl. No. 13/053,615.
USPTO Office Action dated Nov. 10, 2011 for copending U.S. Appl. No. 12/975,447.
USPTO Office Action dated Mar. 2, 2012 for copending U.S. Appl. No. 12/966,518.
Copending U.S. Appl. No. 11/648,955, filed Jan. 3, 2007.
USPTO Office Action dated May 21, 2012 for copending U.S. Appl. No. 12/981,982.
USPTO Notice of Allowance dated Jun. 4, 2012 for copending U.S. Appl. No. 12/981,960.
USPTO Notice of Allowance dated Jun. 7, 2012 for copending U.S. Appl. No. 12/966,487.
Database WPI, Thomson Scientific, London, GB AN2004/520211 XP002639794 & JP2004/137418 Dated May 13, 2004—abstract.
USPTO Notice of Allowance dated Jun. 11, 2012 for copending U.S. Appl. No. 12/966,512.
USPTO Notice of Allowance dated Jun. 13, 2012 for copending U.S. Appl. No. 12/966,502.
USPTO Notice of Allowance dated Jun. 29, 2012 for copending U.S. Appl. No. 12/981,950.
USPTO Notice of Allowance dated Jul. 3, 2012 for copending U.S. Appl. No. 12/974,452.
USPTO Office Action dated Jul. 5, 2012 for copending U.S. Appl. No. 12/966,507.
USPTO Notice of Allowance dated Jul. 6, 2012 for copending U.S. Appl. No. 12/975,456.
USPTO Notice of Allowance dated Jul. 27, 2012 for copending U.S. Appl. No. 12/981,982.
USPTO Notice of Allowance dated Jul. 19, 2012 for copending U.S. Appl. No. 12/981,950.
USPTO Notice of Allowance dated Aug. 10, 2012 for copending U.S. Appl. No. 12/975,487.
USPTO Office Action dated Aug. 14, 2012 for copending U.S. Appl. No. 12/199,304.
USPTO Notice of Allowance dated Jul. 31, 2012 for copending U.S. Appl. No. 12/975,456.
USPTO Office Action dated Aug. 27, 2012 for copending U.S. Appl. No. 12/975,443.
Copending U.S. Appl. No. 13/352,362, filed Jan. 18, 2012.
USPTO Office Action dated Nov. 7, 2012 for copending U.S. Appl. No. 13/273,720.
Investigation of the utility of islands-in-the-stream bicomponent fiber technology in the spunbound process. Fedorova, Dec. 2006 (retrieved on Mar. 20, 2012 from Internet) pp. 22-23, 74 <URL: http://repository.lib.ncsu.edu/ir/bitstream/1840.16/5145/1/etd.pdf>.
"Choosing the Proper Short Cut Fiber", technical data sheet, MiniFibers, Inc., [online] pp. 1-2, 2006, [retrieved on Feb. 15, 2006], Retrieved from the Inernet: <URL: htts://www.minifibers.com/Literature/choosing_fiber.htm>.
Keith, James M., "Dispersions fo Synthetic Fibers in Wet-Lay Nonwovens". MiniFIBERS, Inc., originally published in the Tappi Journal, vol. 77, No. 6, Jun. 1994, entire document.
USPTO Office Action dated Aug. 31, 2011 for copending U.S. Appl. No. 13/053,615.
PCT International Search Report dated Feb. 28, 2012 for Application No. PCT/US2011/057002.
USPTO Office Action dated Aug. 28, 2012 for copending U.S. Appl. No. 12/975,447.
New co-pending U.S. Appl. No. 13/687,466, filed Nov. 28, 2012.
New co-pending U.S. Appl. No. 13/687,472, filed Nov. 28, 2012.
New co-pending U.S. Appl. No. 13/687,478, filed Nov. 28, 2012.
New co-pending U.S. Appl. No. 13/687,493, filed Nov. 28, 2012.
New co-pending U.S. Appl. No. 13/687,505, filed Nov. 28, 2012.
PCT International Search Report dated Feb. 28, 2012 for Application No. PCT/US2011/056990.
PCT International Search Report dated Feb. 28, 2012 for Application No. PCT/US2011/056994.
PCT International Search Report dated Feb. 14, 2012 for Application No. PCT/US2011/056989.
PCT International Search Report dated Feb. 28, 2012 for Application No. PCT/US2011/056995.
PCT International Search Report dated Feb. 28, 2012 for Application No. PCT/US2011/056991.
U.S. Appl. No. 61/592,974, filed Jan. 31, 2010, Parker, et al.
U.S. Appl. No. 61/405,306, filed Oct. 21, 2010, Rakesh Kumar Gupta, et al.
U.S. Appl. No. 61/405,312, filed Oct. 21, 2010, Rakesh Kumar Gupta, et al.
U.S. Appl. No. 61/588,744, filed Nov. 11, 2011, Clark, et al.
U.S. Appl. No. 61/592,854, filed Jan. 31, 2012, Parker, et al.
U.S. Appl. No. 61/592,867, filed Jan. 31, 2010, Parker, et al.
U.S. Appl. No. 61/592,876, filed Jan. 31, 2010, Parker, et al.
U.S. Appl. No. 61/592,917, filed Jan. 31, 2010, Parker, et al.
USPTO Office Action dated May 10, 2012 for copending U.S. Appl. No. 12/966,521.
USPTO Office Action dated Mar. 16, 2012 for copending U.S. Appl. No. 12/966,483.
USPTO Notice of Allowance dated Apr. 2, 2012 for copending U.S. Appl. No. 12/966,502.
USPTO Notice of Allowance dated Apr. 18, 2012 for copending U.S. Appl. No. 12/966,494.
USPTO Office Action dated Apr. 23, 2012 for copending U.S. Appl. No. 12/966,507.
USPTO Office Action dated Apr. 19, 2012 for copending U.S. Appl. No. 12/975,456.
USPTO Office Action dated Apr. 19, 2012 for copending U.S. Appl. No. 12/975,463.
USPTO Office Action dated Nov. 10, 2011 for copending U.S. Appl. No. 12/981,950.
USPTO Office Action dated Jan. 25, 2012 for copending U.S. Appl. No. 12/981,982.
USPTO Notice of Allowance dated Jan. 3, 2012 for copending U.S. Appl. No. 12/975,487.
USPTO Notice of Allowance dated Dec. 23, 2011 for copending U.S. Appl. No. 12/975,452.
USPTO Notice of Allowance dated Apr. 2, 2012 for copending U.S. Appl. No. 12/975,452.
USPTO Notice of Allowance dated Dec. 28, 2011 for copending U.S. Appl. No. 12/981,960.
USPTO Notice of Allowance dated Mar. 15, 2012 for copending U.S. Appl. No. 12/981,960.
USPTO Notice of Allowance dated Dec. 13, 2011 for copending U.S. Appl. No. 12/966,487.
USPTO Notice of Allowance dated Apr. 13, 2012 for copending U.S. Appl. No. 12/966,487.
USPTO Notice of Allowance dated Dec. 9, 2011 for copending U.S. Appl. No. 12/966,512.

USPTO Notice of Allowance dated Mar. 21, 2012 for copending U.S. Appl. No. 12/966,512.
USPTO Office Action dated Dec. 21, 2004 for U.S. Appl. No. 10/850,548.
USPTO Notice of Allowance dated Jun. 8, 2005 for U.S. Appl. No. 10/850,548.
USPTO Office Action dated Mar. 26, 2009 for U.S. Appl. No. 11/344,320.
USPTO Office Action dated Mar. 30, 2009 for U.S. Appl. No. 11/204,868.
USPTO Notice of Allowance dated Nov. 9, 2009 for U.S. Appl. No. 11/648,955.
USPTO Office Action dated Dec. 22, 2009 for U.S. Appl. No. 11/204,868.
USPTO Office Action dated Dec. 24, 2009 for U.S. Appl. No. 11/344,320.
USPTO Notice of Allowance dated Jun. 9, 2010 for U.S. Appl. No. 11/204,868.
USPTO Notice of Allowance dated Jun. 9, 2010 for U.S. Appl. No. 11/344,320.
USPTO Office Action dated Aug. 6, 2010 for U.S. Appl. No. 11/648,953.
USPTO Office Action dated Sep. 27, 2010 for U.S. Appl. No. 12/199,304.
USPTO Notice of Allowance dated Sep. 30, 2010 for U.S. Appl. No. 11/344,320.
USPTO Notice of Allowance dated Oct. 14, 2010 for U.S. Appl. No. 11/204,868.
USPTO Office Action dated Mar. 18, 2011 for U.S. Appl. No. 11/648,953.
USPTO Notice of Allowance dated Apr. 4, 2011 for U.S. Appl. No. 12/199,304.
USPTO Office Action dated Apr. 4, 2011 for U.S. Appl. No. 12/981,960.
USPTO Office Action dated Apr. 6, 2011 for U.S. Appl. No. 12/975,482.
USPTO Office Action dated Apr. 6, 2011 for U.S. Appl. No. 12/975,487.
USPTO Office Action dated May 27, 2011 for U.S. Appl. No. 12/975,452.
USPTO Office Action dated Jun. 7, 2011 for U.S. Appl. No. 12/982,001.
USPTO Office Action dated Jun. 9, 2011 for U.S. Appl. No. 12/975,459.
USPTO Office Action dated Jun. 23, 2011 for U.S. Appl. No. 12/966,487.
USPTO Office Action dated Jun. 23, 2011 for U.S. Appl. No. 12/966,502.
USPTO Office Action dated Jun. 23, 2011 for U.S. Appl. No. 12/975,443.
USPTO Notice of Allowance dated Jul. 18, 2011 for U.S. Appl. No. 12/199,304.
USPTO Office Action dated Aug. 10, 2011 for U.S. Appl. No. 12/966,512.
USPTO Office Action dated Aug. 24, 2011 for U.S. Appl. No. 12/975,456.
USPTO Office Action dated Aug. 31, 2011 for U.S. Appl. No. 13/053,615.
USPTO Office Action dated Sep. 1, 2011 for U.S. Appl. No. 12/975,450.
USPTO Office Action dated Sep. 8, 2011 for U.S. Appl. No. 12/966,494.
USPTO Office Action dated Sep. 15, 2011 for U.S. Appl. No. 11/648,953.
USPTO Office Action dated Sep. 26, 2011 for U.S. Appl. No. 12/966,507.
USPTO Office Action dated Sep. 27, 2011 for U.S. Appl. No. 12/975,463.
PCT International Search Report dated Feb. 7, 2005 for International Application PCT/US2004/018682.
PCT International Search Report dated Feb. 4, 2008 for International Application PCT/US2007/001082.
PCT International Search Report dated Nov. 6, 2008 for International Application PCT/US2007/025661.
PCT International Search Report dated Jul. 3, 2009 for International Application PCT/US2009/001717.
PCT International Search Report dated Dec. 30, 2009 for International Application PCT/US2007/025770.
USPTO Office Action dated Oct. 4, 2012 for copending U.S. Appl. No. 13/273,745.
USPTO Notice of Allowance dated Oct. 11, 2012 for copending U.S. Appl. No. 12/975,487.
USPTO Notice of Allowance dated Oct. 22, 2012 for copending U.S. Appl. No. 12/966,518.
USPTO Notice of Allowance dated Nov. 2, 2012 for copending U.S. Appl. No. 12/966,507.
USPTO Office Action dated Nov. 2, 2012 for copending U.S. Appl. No. 13/273,692.
USPTO Office Action dated Nov. 7, 2012 for copending U.S. Appl. No. 13/273,720—now abandoned.
USPTO Office Action dated Nov. 20, 2012 for copending U.S. Appl. No. 13/273,710.
USPTO Office Action dated Nov. 26, 2012 for copending U.S. Appl. No. 13/273,648.
USPTO Office Action dated Dec. 4, 2012 for copending U.S. Appl. No. 13/273,749.
USPTO Notice of Allowance dated Dec. 10, 2012 for copending U.S. Appl. No. 12/966,521.
USPTO Notice of Allowance dated Jan. 8, 2012 for copending U.S. Appl. No. 12/966,483.
USPTO Notice of Allowance dated Jan. 10, 2012 for copending U.S. Appl. No. 12/975,447.
USPTO Notice of Allowance dated Jan. 15, 2012 for copending U.S. Appl. No. 12/975,463.
PCT International Search Report dated Jan. 23, 2013 for International Application No. PCT/US2012/064272.
USPTO Notice of Allowance dated Jan. 25, 2012 for copending U.S. Appl. No. 12/966,521.
USPTO Notice of Allowance dated Jan. 28, 2012 for copending U.S. Appl. No. 12/765,461.
Co-pending U.S. Appl. No. 13/687,466, filed Nov. 28, 2012.
Co-pending U.S. Appl. No. 13/687,472, filed Nov. 28, 2012.
Co-pending U.S. Appl. No. 13/687,478, filed Nov. 28, 2012.
Co-pending U.S. Appl. No. 13/687,493, filed Nov. 28, 2012.
Co-pending U.S. Appl. No. 13/687,505, filed Nov. 28, 2012.
USPTO Notice of Allowance dated Mar. 21, 2013 for copending U.S. Appl. No. 12/975,482.
USPTO Notice of Allowance dated Mar. 22, 2013 for copending U.S. Appl. No. 12/966,518.
USPTO Notice of Allowance dated May 1, 2013 for copending U.S. Appl. No. 12/975,482.
PCT International Search Report dated Mar. 27, 2013 for International Application No. PCT/US2013/022832.
PCT International Search Report dated Mar. 27, 2013 for International Application No. PCT/US2013/022834.
PCT International Search Report dated Mar. 27, 2013 for International Application No. PCT/US2013/022835.
PCT International Search Report dated Mar. 27, 2013 for International Application No. PCT/US2013/022838.
PCT International Search Report dated Mar. 29, 2013 for International Application No. PCT/US2013/022830.
USPTO Notice of Allowance dated Mar. 28, 2013 for copending U.S. Appl. No. 12/966,521.
USPTO Notice of Allowance dated Apr. 24, 2013 for copending U.S. Appl. No. 12/199,304.
USPTO Notice of Allowance dated Apr. 8, 2013 for copending U.S. Appl. No. 12/966,483.
USPTO Notice of Allowance dated Jan. 8, 2013 for copending U.S. Appl. No. 12/966,483.
USPTO Notice of Allowance dated Jan. 10, 2013 for copending U.S. Appl. No. 12/975,447.
USPTO Notice of Allowance dated Jan. 15, 2013 for copending U.S. Appl. No. 12/975,463.
USPTO Notice of Allowance dated Jan. 25, 2013 for copending U.S. Appl. No. 12/966,521.
USPTO Notice of Allowance dated Apr. 16, 2013 for copending U.S. Appl. No. 12/765,461.

* cited by examiner

SULFOPOLYESTERS FOR PAPER STRENGTH AND PROCESS

CROSS-REFERENCE TO RELATED APPLICATIONS

This application claims priority to U.S. Provisional Application Ser. No. 61/172,257 filed Apr. 24, 2009, the disclosure of which is incorporated herein by reference in its entirety.

FIELD OF THE INVENTION

This invention provides a method of improving the wet-strength of cellulosic paper while enhancing the repulpability.

BACKGROUND OF THE INVENTION

Wet strength resins are often added to paper products including paperboard at the time of manufacture. In the absence of wet strength resins, paper normally retains only 3% to 5% of its strength after being wetted with water. However, paper made with wet strength resin generally retains at least 10%-50% of its strength when wet. Wet strength is useful in a wide variety of paper applications, some examples of which are toweling, milk and juice cartons, paper bags, and liner board for corrugated containers.

As stated in Handbook for Pulp and Paper Technologists, Gary A. Smook, Angus Wilde Publications, 1992 (which is incorporated herein by reference): "Paper has traditionally been defined as a felted sheet formed on a fine screen from a water suspension of fibers. Current paper products generally conform to this definition except that most products also contain non-fibrous additives. Dry forming methods are now utilized for the manufacture of a few specialty paper products. Pulp is the fibrous raw material for papermaking. Pulp fibers are usually of vegetable origin, but animal, mineral, or synthetic fibers may be used for special applications. The distinction between paper and paperboard is based on product thickness. Nominally, all sheets above 0.3 mm thickness are classed as paperboard; but enough exceptions are applied to make the distinction somewhat hazy."

Because of increased commercial emphasis on developing paper products based on recovered or recycled cellulose, there is growing interest in developing paper which is readily repulpable. Paper and paperboard waste materials are difficult to repulp in aqueous systems without special chemical treatment when they contain wet strength resins.

Improving the repulpability of paper containing wet strength resins has generally been achieved by modifying the repulping conditions. However, many conventional repulping processes used for wet strength paper result in the formation of environmentally undesirable chlorine-containing degradation products, involve strong oxidizing agents, or proceed slowly.

There is a need for improved methods for making paper products that will be readily repulpable without significantly lowering the wet and dry strength properties of the paper.

BRIEF SUMMARY OF THE INVENTION

The present invention relates to repulpable paper products comprising: papermaking fibers; cationic strength additives; and sulfopolyester thermoplastic resins.

The present invention also relates to methods of improving the wet-strength of paper which comprises adding to the paper during the papermaking process cationic strength additives; and sulfopolyester thermoplastic resins.

The present invention relates to paper products comprising: papermaking fibers; cationic strength additives; and sulfopolyester thermoplastic resins.

The present invention relates to methods of improving the wet-strength of cellulosic paper comprising adding to the papermaking fibers during the papermaking process cationic strength additives and sulfopolyester thermoplastic resins.

DETAILED DESCRIPTION

The present invention may be understood more readily by reference to the following detailed description of the invention and to the Examples included therein.

Before the present compositions of matter and methods are disclosed and described, it is to be understood that this invention is not limited to specific synthetic methods or to particular formulations, unless otherwise indicated, and, as such, may vary from the disclosure. It is also to be understood that the terminology used is for the purpose of describing particular embodiments only, and is not intended to limit the scope of the invention.

The singular forms "a", "an", and the the include plural referents, unless the context clearly dictates otherwise.

Optional or optionally means that the subsequently described events or circumstances may or may not occur. The description includes instances where the events or circumstances occur, and instances where they do not occur.

Unless otherwise indicated, all numbers expressing quantities of ingredients, properties such as molecular weight, reaction conditions, and so forth used in the specification and claims are to be understood as being modified in all instances by the term "about." Ranges may be expressed herein as from about one particular value, and/or to about another particular value. When such a range is expressed, it is to be understood that another embodiment is from the one particular value and/or to the other particular value, along with all combinations within said range. Accordingly, unless indicated to the contrary, the numerical parameters set forth in the following specification and attached claims are approximations that may vary depending upon the desired properties sought to be obtained by the present invention. At the very least, each numerical parameter should at least be construed in light of the number of reported significant digits and by applying ordinary rounding techniques. Further, the ranges stated in this disclosure and the claims are intended to include the entire range specifically and not just the endpoint(s). For example, a range stated to be 0 to 10 is intended to disclose all whole numbers between 0 and 10 such as, for example 1, 2, 3, 4, etc., all fractional numbers between 0 and 10, for example 1.5, 2.3, 4.57, 6.1113, etc., and the endpoints 0 and 10.

Throughout this application, where patents or publications are referenced, the disclosures of these references in their entireties are intended to be incorporated by reference into this application, in order to more fully describe the state of the art to which the invention pertains.

Some relevant technical terms as used in the context of the present invention are meant to be understood as follows (unless specifically indicated otherwise throughout the description).

"Papermaking fibers," as used herein, include all known cellulosic fibers or fiber mixes comprising cellulosic fibers. Fibers suitable for making the webs of this invention comprise any natural or synthetic cellulosic fibers including, but not limited to non-woody fibers, such as cotton or cotton derivatives, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers may be prepared in high-yield or low-yield forms and may be pulped in any known method, including kraft, sulfite, groundwood, thermomechanical pulp (TMP), chemithermomechanical pulp (CTMP), and bleached chemithermomechanical pulp (BCTMP), high-yield pulping methods and other known pulping methods. High brightness pulps, including chemically bleached pulps, may be used and unbleached or semi-bleached pulps may also be used. Recycled fibers are included within the scope of the present invention. Any known pulping and bleaching methods may be used. Fibers prepared from organosolv pulping methods may also be used. Suitable papermaking fibers may also include recycled fibers, virgin fibers, or mixes thereof.

Synthetic cellulose fibers are also suitable for use including rayon in all its varieties and other fibers derived from viscose or chemically modified cellulose. Chemically treated natural cellulosic fibers may be used such as mercerized pulps, chemically stiffened or crosslinked fibers, sulfonated fibers, and the like. Suitable synthetic polymeric fibers include rayon, polyolefin fibers, polyester fibers, polyamide fibers and the like. Suitable synthetic polymer fiber structures include monocomponent, bicomponent, and multi component fibers such as core-sheath, islands-in-the-sea, side-by-side, segmented pie, and the like.

In one embodiment of the present invention the papermaking fibers comprise woody fibers, softwood Kraft pulp, hardwood Kraft pulp, recycled fibers, non-woody fibers, synthetic polymeric fibers, glass fibers, or combinations thereof. In one embodiment the synthetic polymeric fibers have a mean fiber diameter of less than 5 microns. In another embodiment the synthetic polymeric fibers comprise greater than 50% of the total papermaking fiber or greater than 70% of the total papermaking fiber.

For good mechanical properties in using papermaking fibers, it may be desirable that the fibers be relatively undamaged and largely unrefined or only lightly refined. While recycled fibers may be used, virgin fibers are also useful for their mechanical properties and lack of contaminants. Mercerized fibers, regenerated cellulosic fibers, cellulose produced by microbes, rayon, and other cellulosic material or cellulosic derivatives may be used. Suitable papermaking fibers may also include recycled fibers, virgin fibers, or mixes thereof.

As used herein, "high yield Pulp fibers" are those papermaking fibers of pulps produced by pulping processes providing a yield of about 65 percent or greater. Yield is the resulting amount of processed fiber expressed as a percentage of the initial wood mass. High yield pulps include bleached chemithermomechanical pulp (BCTMP), chemithermomechanical pulp (CTMP) pressure/pressure thermomechanical pulp (PTMP), thermomechanical pulp (TMP), thermomechanical chemical pulp (TMCP), high yield sulfite pulps, and high yield Kraft pulps, all of which contain fibers having high levels of lignin. Characteristic high-yield fibers can have lignin content by mass of about 1 percent or greater. Suitable high yield pulp fibers, after being prepared by pulping and optional bleaching steps and prior to being formed into dry bales or webs, in one embodiment can also be characterized by being comprised of comparatively whole, relatively undamaged fibers, high freeness (250 Canadian Standard Freeness (CSF) or greater, and low fines content (less than 25 percent by the Britt jar test). In one embodiment, the high-yield fibers are predominately softwood, for example northern softwood.

As used herein, the term "cellulosic" is meant to include any material having cellulose as a major constituent, and specifically comprising about 50 percent or more by weight of cellulose or cellulose derivatives. Thus, the term includes cotton, typical wood pulps, non-woody cellulosic fibers, cellulose acetate, cellulose triacetate, rayon, viscose fibers, thermomechanical wood pulp, chemical wood pulp, debonded chemical wood pulp, lyocell and other fibers formed from solutions of cellulose in NMMO, milkweed, or bacterial cellulose. Fibers that have not been spun or regenerated from solution may be used exclusively, if desired, or at least about 80% of the web may be free of spun fibers or fibers generated from a cellulose solution.

One aspect of the present invention relates to the production of paper products including paper and paper board from an aqueous slurry of papermaking fibers. It was discovered that the paper products of the present invention containing a cationic strength additive and a sulfopolyester thermoplastic resin resulted in paper products with improved or maintained wet strength and dry strength and with significantly enhanced repulpability.

One embodiment of the present invention relates to repulpable paper product comprising: papermaking fibers; cationic strength additives; and thermoplastic sulfopolyester resins.

Another embodiment of the present invention relates to paper product comprising: papermaking fibers; cationic strength additives; and thermoplastic sulfopolyester resins. The paper products according the present invention provide enhance repulpability.

In addition to enhanced repulability the paper products according to the present invention also provide enhanced sheet strength, increased machine speed, and improved retention. The present invention also allows the papermakers to simplify the wet end by reducing or eliminating the use of certain wet end additives, including dry strength resins, cationic starches, drainage and retention aids, and coagulants. When the present invention is used as both a wet and dry strength aid, the absorbency of the paper product is not decreased. The present invention provides the following improvements in sheet performance: lower basis weight, increased recycle fiber utilization, the ability to provide dispersion at higher concentration or in solid form, extended shelf life, reduced Kraft utilization, immediate cure, improved print receptivity, improved surface strength, improved sheet processibility, improved machine runnability, increased production, higher sheet ash content and filler cost savings, improved fiber recovery, reduced whitewater solids and turbidity, increased retention of wet strength additive, reduced system deposition, provides high levels of controllable drainage, improved formation, increased machine speed, reduced dryer energy consumption, simplified and cleaner wet end resulting from fewer additives, cost-effective additive scheme, and wet end chemical efficiency gains.

It is common to include various inorganic and organic materials to the aqueous slurry of pulp or papermaking fibers for improving the paper products and the papermaking process. The process of making the paper products according to the present invention can be carried out on any conventional paper making apparatus.

In general, the process of the present invention includes providing a slurry of papermaking fibers, adding the components of the present invention to the slurry of pulp papermaking fibers, depositing the slurry of pulp papermaking fibers containing the components of the present invention on a forming fabric, and drying the slurry to form a paper web.

In one embodiment of the present invention, the fibrous web to be formed from the papermaking fibers treated in accordance with the present invention may be wet-laid, such as webs may be formed with known papermaking techniques wherein the dilute aqueous fiber slurry is disposed on a moving wire to filter out the fibers and form a paper web which is subsequently dewatered by combinations of units including suction boxes, wet presses, dryer units, and the like. Capillary dewatering may also be applied to remove water from the web.

Any conventional drying method or dryers may be used according to the present invention. Drying operations may include drum drying, through drying, steam drying such as superheated steam drying, displacement dewatering, Yankee drying, infrared drying, microwave drying, radio frequency drying in general, and impulse drying.

A moist fibrous web may also be formed by foam forming processes, wherein the treated fibers are entrained or suspended in a foam prior to dewatering, or wherein foam is applied to a paper web prior to dewatering or drying.

The fibrous web is generally a random plurality of papermaking fibers that can, optionally, be joined together with a binder. Any papermaking fibers, as herein defined, or mixtures thereof may be used, such as bleached fibers from a kraft or sulfite chemical pulping process. Recycled fibers may also be used, as may cotton linters or papermaking fibers comprising cotton. Both high-yield and low-yield fibers may be used. In one embodiment, the fibers may be predominantly hardwood, such as at least 50% hardwood or about 60% hardwood or greater or about 80% hardwood or greater or substantially 100% hardwood. In another embodiment, the web is predominantly softwood, such as at least about 50% softwood or at least about 80% softwood, or about 100% softwood. In another embodiment, the web is predominantly synthetic polymeric fiber, such as at least about 50% synthetic polymeric fiber or at least about 80% synthetic polymeric fiber, or about 100% synthetic polymeric fiber.

The fibrous web of the present invention may be formed from a single layer or multiple layers. Stratified webs may also be formed wherein at least one layer comprises softwood fibers while another layer comprises hardwood or other fiber types. Layered structures produced by any means known in the art are within the scope of the present invention. In the case of multiple layers, the layers are generally positioned in a juxtaposed or surface-to-surface relationship and all or a portion of the layers may be bound to adjacent layers. The paper web may also be formed from a plurality of separate paper webs wherein the separate paper webs may be formed from single or multiple layers.

One embodiment of the present invention provides a method of improving the wet-strength of a cellulosic paper which comprises adding to the paper during the papermaking process a cationic strength additive; and a sulfopolyester thermoplastic resin.

The process for manufacturing paper products or the repulpable paper products according to the present invention comprises a number of steps. One step comprises forming an aqueous slurry of papermaking fibers or pulp or which can be performed by conventional means, i.e., known mechanical, chemical and semi-chemical, etc., pulping processes. Another step comprises adding to the aqueous slurry of papermaking fibers or pulp cationic strength additives and thermoplastic sulfopolyester resins. This can be done at any point, before sheet formation or it can also be applied after sheet formation from a tub size or at a size press or from showers to the dried or partially dried sheet. Yet another step comprises sheeting and drying the aqueous slurry of papermaking or pulp fibers containing the cationic thermosetting resin. This can be done by any conventional means.

In one embodiment, the components of the present invention comprising the cationic strength additives and the thermoplastic sulfopolyester resins are added to the pulp slurry separately, though depending on desired strength characteristics of the web, either the cationic strength additives or the thermoplastic sulfopolyester resins may be added to the slurry before the other.

During the papermaking process, the cationic strength additive can be incorporated by various methods including addition in the pulp fiber slurry or incorporation at the pulp press. In one embodiment of the present invention, the cationic strength additives are added to the slurry before the sulfopolyester thermoplastic resin. Without being bound by any theory, the cationic strength additive bonds to the anionically charged cellulose pulp fibers which results in a positively charged pulp fiber. Subsequently, the anionically charged sulfopolyester thermoplastic resin is applied to pulp fiber which results in an ionic bond. The sulfopolyester resin can be applied by various methods including spray application.

In another embodiment, the process of the present invention includes providing a slurry of pulp or papermaking fibers, sequentially adding the components of the present invention to the aqueous slurry of pulp or papermaking fibers, depositing the slurry of pulp or papermaking fibers containing the components of the present invention on a forming fabric, and drying the slurry to form a paper web. Such components may also be sprayed, printed, or coated onto the web after formation, while wet, or added to the wet end of the papermaking machine prior to formation.

According to the present invention, the components comprising the cationic strength additives and the thermoplastic sulfopolyester resins may be added to the slurry in a ratio from about a 1:5 to about a 5:1, as desired.

The pH of the slurry may be adjusted during the process. For example, the pH of the slurry may be adjusted to an acidic pH, such as about 6 or less in one embodiment. In another embodiment, however, the pH may be adjusted to greater than about 6. When the desired viscosity is reached, sufficient water is then added to adjust the solids content of the resin solution to about 15% or less, the product cooled to about 25° C. and then stabilized by adding sufficient acid to reduce the pH at least to about 6 and preferably to about 5. Any suitable acid such as hydrochloric, sulfuric, nitric, formic, phosphoric and acetic acid may be used to stabilize the product.

The paper web of the present invention may have any conventional bulk weight. In one embodiment, the paper web of the present invention may have a bulk greater than about 2 cc/g. For example, the paper web may have a bulk greater than about 5 cc/g. The dry tensile index of the paper web may be any conventional value. For example, the dry tensile index of the paper web can be greater than about 20 Nm/g in one embodiment. In another embodiment, the dry tensile index of the paper web can be greater than about 22 Nm/g. In yet another embodiment, the dry tensile index can be greater than about 25 Nm/g. In general, the basis weight of the paper webs of the present invention can be any desired basis weight. For instance, in one embodiment, the paper web may have a basis weight between about 5 and about 200 gsm.

Other conventional chemical additives that can be used in the papermaking process according to the present invention are: rosin size, reactive size (alkenyl succinic anhydride or alkyl ketene dimer), surface size, starch, retention aids, drainage aids, formation aids, flocculants, creping aids (adhesives and release agents), dry strength resins (cationic starch, guar gums, polyacrylamides), defoamers, scavengers for anionic trash and stickies control, fillers (clay, calcium carbonate, titanium dioxide), optical brightening aids and dyes.

Cationic Strength Additives

During papermaking and wet laid nonwovens hydraulic manufacturing processes, chemical additives are often incorporated to improve the wet strength and/or dry strength of paper and paperboard products. These chemical additives are commonly known as wet and dry strength additives and are available from a number of commercially available sources.

Examples of permanent wet strength additives include polyamide epichlorohydrin and polyamidoamine epichlorohydrin and are collectively known as PAE resins. Examples of wet strength additives are based on chemistries such as polyacrylamide and glyoxalated polyacrylamide (GPAM) resins.

According to the present invention, the cationic strength additives may consist of either wet strength or dry strength additives and include glyoxylated polyacrylamides, polyacrylamides, polyamide epichlorohydrins (PAEs), starches and other cationic additives well known to those skilled in the art.

Polyamide epichlorohydrin, polyamidoamine epichlorohydrin and polyamine epichlorohydrin resins and are collectively known as PAE resins. PAE resins are widely used in the papermaking industry due to their ability to impart a high degree of wet strength to numerous paper products, including tissue, towel, wipes and corrugated board. PAE resins do not improve the dry strength of paper or paperboard and products containing these resins are generally considered not to be repulpable. Paper products containing wet strength additives, although generally repulpable; often have insufficient wet strength for many applications. Upon complete wetting, paper products derived from wet strength additives typically degrade within minutes to hours.

Suitable cationic strength additives used in accordance with the present invention include PAE resins, glyoxylated polyacrylamide resins, starches, polyacrylamides, and other wet strength and dry strength additives commonly known to those skilled in the art.

Procedures for making PAE resins are well known in the literature and are described in more detail in U.S. Pat. No. 3,772,076, which is incorporated herein by reference. PAE resins are sold by Ashland, Inc., Wilmington, Del., under the trade name Kymene® and by Georgia Pacific, Inc., Atlanta, Ga., under the trade name Amres®. A typical procedure for synthesizing a PAE resin is as follows. A polyalkylene polyamine is reacted with an aliphatic dicarboxylic acid to form a polyamidoamine backbone. An example of a polyamidoamine is the reaction product of diethylenetriamine with an adipic acid or ester of a dicarboxylic acid derivative. The resulting polyamidoamine is then reacted with epichlorohydrin in aqueous solution. The resulting product is diluted and neutralized with a strong mineral acid to a pH below 3.0.

Acrylamide polymers modified with glyoxal are known as glyoxalated polyacrylamide resins. Procedures for synthesizing glyoxylated polyacrylamide are well known in the literature and are described in more detail in U.S. Pat. No. 3,556,932, which is incorporated herein by reference. Glyoxylated polyacrylamide resins are sold by Kemira, Inc., Kennesaw, Georgia, under the trade name Parez®. The acrylamide polymer may contain monomers to modify ionic properties. The acrylamide base polymer is reacted with sufficient glyoxal under aqueous alkaline conditions until a slight increase in viscosity occurs. The resulting product is then quenched with acid. Approximately half of the added glyoxyal remains unreacted and dissolved in the water. It is also possible to preblend the acrylamide polymer and glyoxal in a dry particulate state and subsequently add this blend to warm water to form a glyoxalated polyacrylamide resin.

Dry strength additives include materials such as starches that may be cationic, quaternary or nonionic in nature. Examples of dry strength additives suitable for use in the present invention include cationic derivatives of polysaccharides (such as starch, guar, cellulose, and chitin); polyamine; polyethyleneimine; vinylalcohol-vinylamine copolymers; cationic acrylic homo- and copolymers such as polyacrylamide, polydiallyldimethylammonium chloride and copolymers of acrylic acid, acrylic esters and acrylamide with diallyldimethylammonium chloride, acryloyloxyethyltrimethylammonium chloride, methacryloyloxyethyltrimethylammonium methylsulfate, methacryloyloxyethyltrimethylammonium chloride and methacrylamidopropyltrimethylammonium chloride.

Other cationic strength resins that may be used in the present invention are: aminopolyamide-epi resins (e.g. Kymene® 557H-resin); polyamine-epi resins (e.g. Kymene® 736 resin), epoxide resins (e.g. Kymene® 450 and Kymene® 2064 resins); polyethylenimine, ureaformaldehyde resins; melamine-formaldehyde resins; glyoxalated polyacrylamides (e.g. Hercobond® 1000 resin, Parez 631NC); polyisocyanates; and reactive starches (oxidized starch, dialdehyde starch, blocked reactive group starch).

The amount of cationic strength additive is generally from about 0.25 to about 3.00 weight % on a dry basis, based on the weight of the dried paper. For example in some embodiments of the present invention the amount of cationic strength additive is from about 0.25-3.00 weight percent, 0.25-2.00 weight percent, or 0.25-1.50 weight percent. In other embodiments, the cationic strength additive may be about 2 weight % on a dry basis, based on the weight of the dried paper, or about 1 weight %, or about 0.5 weight %. In one embodiment of the present invention similar amounts of wet strength additive and sulfopolyester are used.

Sulfopolyester Thermoplastic Resins

The sulfopolyesters of the present invention comprisedicarboxylic acid monomer residues, sulfomonomer residues, diol monomer residues, and repeating units. The sulfomonomer may be a dicarboxylic acid, a diol, or hydroxycarboxylic acid. Thus, the term "monomer residue", as used herein, means a residue of a dicarboxylic acid, a diol, or a hydroxycarboxylic acid. A "repeating unit", as used herein, means an organic structure having 2 monomer residues bonded through a carbonyloxy group. The sulfopolyesters of the present invention contain substantially equal molar proportions of acid residues (100 mole %) and diol residues (100 mole %) which react in substantially equal proportions such that the total moles of repeating units is equal to 100 mole %. The mole percentages provided in the present disclosure, therefore, may be based on the total moles of acid residues, the total moles of diol residues, or the total moles of repeating units. For example, a sulfopolyeseter containing 30 mole % of a sulfomonomer, which may be a dicarboxylic acid, a diol, or hydroxycarboxylic acid, based on the total repeating units, means that the sulfopolyester contains 30 mole % sulfomonomer out of a total of 100 mole % repeating units. Thus, there are 30 moles of sulfomonomer residues among every 100 moles of repeating units. Similarly, a sulfopolyeseter containing 30 mole % of a dicarboxylic acid sulfomonomer, based on the total acid residues, means the sulfopolyester contains 30 mole % sulfomonomer out of a total of 100 mole % acid residues. Thus, in this latter case, there are 30 moles of sulfomonomer residues among every 100 moles of acid residues.

The sulfopolyesters described herein have an inherent viscosity, abbreviated hereinafter as "Ih.V.", of at least about 0.1 dL/g, preferably about 0.2 to 0.3 dL/g, and most preferably greater than about 0.3 dL/g, measured in a 60/40 parts by weight solution of phenol/tetrachloroethane solvent at 25.degree. C. and at a concentration of about 0.5 g of sulfopolyester in 100 mL of solvent. The term "polyester", as used herein, encompasses both "homopolyesters" and "copolyesters" and means a synthetic polymer prepared by the polycondensation of difunctional carboxylic acids with difunctional hydroxyl compound. As used herein, the term "sulfopolyester" means any polyester comprising a sulfomonomer. Typically the difunctional carboxylic acid is a dicarboxylic acid and the difunctional hydroxyl compound is a dihydric alcohol such as, for example glycols and diols. Alternatively, the difunctional carboxylic acid may be a hydroxy carboxylic acid such as, for example, p-hydroxybenzoic acid, and the difunctional hydroxyl compound may be a aromatic nucleus bearing 2 hydroxy substituents such as, for example, hydroquinone. The term "residue", as used herein, means any organic structure incorporated into the polymer through a polycondensation reaction involving the corresponding monomer. Thus, the dicarboxylic acid residue may be derived from a dicarboxylic acid monomer or its associated acid halides, esters, salts, anhydrides, or mixtures thereof. As used herein, therefore, the term dicarboxylic acid is intended to include dicarboxylic acids and any derivative of a dicarboxylic acid, including its associated acid halides, esters, half-esters, salts, half-salts, anhydrides, mixed anhydrides, or mixtures thereof, useful in a polycondensation process with a diol to make a high molecular weight polyester.

The sulfopolyester of the present invention includes one or more dicarboxylic acid residues. Depending on the type and concentration of the sulfomonomer, the dicarboxylic acid residue may comprise from about 60 to about 100 mole % of the acid residues. Other examples of concentration ranges of dicarboxylic acid residues are from about 60 mole % to about 95 mole %, and about 70 mole % to about 95 mole %. Examples of dicarboxylic acids that may be used include aliphatic dicarboxylic acids, alicyclic dicarboxylic acids, aromatic dicarboxylic acids, or mixtures of two or more of these acids. Thus, suitable dicarboxylic acids include, but are not limited to succinic; glutaric; adipic; azelaic; sebacic; fumaric; maleic; itaconic; 1,3-cyclohexanedicarboxylic; 1,4-cyclohexanedicarboxylic; diglycolic; 2,5-norbornanedicarboxylic; phthalic; terephthalic; 1,4-naphthalenedicarboxylic; 2,5-naphthalenedicarboxylic; diphenic; 4,4'-oxydibenzoic; 4,4'-sulfonyldibenzoic; and isophthalic. The preferred dicarboxylic acid residues are isophthalic, terephthalic, and 1,4-cyclohexanedicarboxylic acids, or if diesters are used, dimethyl terephthalate, dimethyl isophthalate, and dimethyl-1,4-cyclohexane-dicarboxylate with the residues of isophthalic and terephthalic acid being especially preferred. Although the dicarboxylic acid methyl ester is the most preferred embodiment, it is also acceptable to include higher order alkyl esters, such as ethyl, propyl, isopropyl, butyl, and so forth. In addition, aromatic esters, particularly phenyl, also may be employed.

The sulfopolyester includes about 4 to about 40 mole %, based on the total repeating units, of residues of at least one sulfomonomer having 2 functional groups and one or more sulfonate groups attached to an aromatic or cycloaliphatic ring wherein the functional groups are hydroxyl, carboxyl, or a combination thereof. Additional examples of concentration ranges for the sulfomonomer residues are about 4 to about 35 mole %, about 8 to about 30 mole %, and about 8 to about 25 mole %, based on the total repeating units. The sulfomonomer may be a dicarboxylic acid or ester thereof containing a sulfonate group, a diol containing a sulfonate group, or a hydroxy acid containing a sulfonate group. The term "sulfonate" refers to a salt of a sulfonic acid having the structure "—SO.sub.3M" wherein M is the cation of the sulfonate salt. The cation of the sulfonate salt may be a metal ion such as Li.sup.+, Na.sup.+, K.sup.+, Mg.sup.++, Ca.sup.++, Ni.sup.++, Fe.sup.++, and the like. Alternatively, the cation of the sulfonate salt may be non-metallic such as a nitrogenous base as described, for example, in U.S. Pat. No. 4,304,901. Nitrogen-based cations are derived from nitrogen-containing bases, which may be aliphatic, cycloaliphatic, or aromatic compounds. Examples of such nitrogen containing bases include ammonia, dimethylethanolamine, diethanolamine, triethanolamine, pyridine, morpholine, and piperidine. Because monomers containing the nitrogen-based sulfonate salts typically are not thermally stable at conditions required to make the polymers in the melt, the method of this invention for preparing sulfopolyesters containing nitrogen-based sulfonate salt groups is to disperse, dissipate, or dissolve the polymer containing the required amount of sulfonate group in the form of its alkali metal salt in water and then exchange the alkali metal cation for a nitrogen-based cation.

When a monovalent alkali metal ion is used as the cation of the sulfonate salt, the resulting sulfopolyester is completely dispersible in water with the rate of dispersion dependent on the content of sulfomonomer in the polymer, temperature of the water, surface area/thickness of the sulfopolyester, and so forth. When a divalent metal ion is used, the resulting sulfopolyesters are not readily dispersed by cold water but are more easily dispersed by hot water. Utilization of more than one counterion within a single polymer composition is possible and may offer a means to tailor or fine-tune the water-responsivity of the resulting article of manufacture. Examples sulfomonomers residues include monomer residues where the sulfonate salt group is attached to an aromatic acid nucleus, such as, for example, benzene; naphthalene; diphenyl; oxydiphenyl; sulfonyldiphenyl; and methylenediphenyl or cycloaliphatic rings, such as, for example, cyclohexyl; cyclopentyl; cyclobutyl; cycloheptyl; and cyclooctyl. Other examples of sulfomonomer residues which may be used in the present invention are the metal sulfonate salt of sulfophthalic acid, sulfoterephthalic acid, sulfoisophthalic acid, or combinations thereof. Other examples of sulfomonomers which may be used are 5-sodiosulfoisophthalic acid and esters thereof. If the sulfomonomer residue is from 5-sodiosulfoisophthalic acid, typical sulfomonomer concentration ranges are about 0.4 to about 35 mole %, about 8 to about 30 mole %, and about 8 to 25 mole %, based on the total moles of acid residues.

The sulfomonomers used in the preparation of the sulfopolyesters are known compounds and may be prepared using methods well known in the art. For example, sulfomonomers in which the sulfonate group is attached to an aromatic ring may be prepared by sulfonating the aromatic compound with oleum to obtain the corresponding sulfonic acid and followed by reaction with a metal oxide or base, for example, sodium acetate, to prepare the sulfonate salt. Procedures for preparation of various sulfomonomers are described, for example, in U.S. Pat. Nos. 3,779,993; 3,018,272; and 3,528,947.

It is also possible to prepare the polyester using, for example, a sodium sulfonate salt, and ion-exchange methods to replace the sodium with a different ion, such as zinc, when the polymer is in the dispersed form. This type of ion exchange procedure is generally superior to preparing the polymer with divalent salts insofar as the sodium salts are usually more soluble in the polymer reactant melt-phase.

The sulfopolyester includes one or more diol residues which may include aliphatic, cycloaliphatic, and aralkyl glycols. The cycloaliphatic diols, for example, 1,3- and 1,4-cyclohexanedimethanol, may be present as their pure cis or trans isomers or as a mixture of cis and trans isomers. As used herein, the term "diol" is synonymous with the term "glycol" and means any dihydric alcohol. Examples diols include ethylene glycol; diethylene glycol; triethylene glycol; polyethylene glycols; 1,3-propanediol; 2,4-dimethyl-2-ethylhexane-1,3-diol; 2,2-dimethyl-1,3-propanediol; 2-ethyl-2-butyl-1,3-propanediol; 2-ethyl-2-isobutyl-1,3-propanediol; 1,3-butanediol; 1,4-butanediol; 1,5-pentanediol; 1,6-hexanediol; 2,2,4-trimethyl-1,6-hexanediol; thiodiethanol; 1,2-cyclohexanedimethanol; 1,3-cyclohexanedimethanol; 1,4-cyclohexanedimethanol; 2,2,4,4-tetramethyl-1,3-cyclobutanediol; p-xylylenediol, or combinations of one or more of these glycols.

The diol residues may include from about 25 mole % to about 100 mole %, based on the total diol residues, of residue of a poly(ethylene glycol) having a structure H—(OCH.sub.2-CH.sub.2).sub.n-OH wherein n is an integer in the range of 2 to about 500. Non-limiting examples of lower molecular weight polyethylene glycols, e.g., wherein n is from 2 to 6, are diethylene glycol, triethylene glycol, and tetraethylene glycol. Of these lower molecular weight glycols, diethylene and triethylene glycol are most preferred. Higher molecular weight polyethylene glycols (abbreviated herein as "PEG"), wherein n is from 7 to about 500, include the commercially available products known under the designation CARBOWAX®, a product of Dow Chemical Company (formerly Union Carbide). Typically, PEG's are used in combination with other diols such as, for example, diethylene glycol or ethylene glycol. Based on the values of n, which range from greater than 6 to 500, the molecular weight may range from greater than 300 to about 22,000 g/mol. The molecular weight and the mole % are inversely proportional to each other; specifically, as the molecular weight is increased, the mole % will be decreased in order to achieve a designated degree of hydrophilicity. For example, it is illustrative of this concept to consider that a PEG having a molecular weight of 1000 may constitute up to 10 mole % of the total diol, while a PEG having a molecular weight of 10,000 would typically be incorporated at a level of less than 1 mole % of the total diol.

Certain dimer, trimer, and tetramer diols may be formed in situ due to side reactions that may be controlled by varying the process conditions. For example, varying amounts of diethylene, triethylene, and tetraethylene glycols may be formed from ethylene glycol from an acid-catalyzed dehydration reaction which occurs readily when the polycondensation reaction is carried out under acidic conditions. The presence of buffer solutions, well-known to those skilled in the art, may be added to the reaction mixture to retard these side reactions. Additional compositional latitude is possible, however, if the buffer is omitted and the dimerization, trimerization, and tetramerization reactions are allowed to proceed.

The sulfopolyester of the present invention may include from 0 to about 25 mole %, based on the total repeating units, of residues of a branching monomer having 3 or more functional groups wherein the functional groups are hydroxyl, carboxyl, or a combination thereof. Non-limiting examples of branching monomers are 1,1,1-trimethylol propane, 1,1,1-trimethylolethane, glycerin, pentaerythritol, erythritol, threitol, dipentaerythritol, sorbitol, trimellitic anhydride, pyromellitic dianhydride, dimethylol propionic acid, or combinations thereof. Further examples of branching monomer concentration ranges are from 0 to about 20 mole % and from 0 to about 10 mole %. The presence of a branching monomer may result in a number of possible benefits to the sulfopolyester of the present invention, including but not limited to, the ability to tailor rheological, solubility, and tensile properties. For example, at a constant molecular weight, a branched sulfopolyester, compared to a linear analog, will also have a greater concentration of end groups that may facilitate post-polymerization crosslinking reactions. At high concentrations of branching agent, however, the sulfopolyester may be prone to gelation.

The sulfopolyesters of the present invention has a glass transition temperature, abbreviated herein as "Tg", of at least 25.degree. C. as measured on the dry polymer using standard techniques, such as differentical scanning calorimetry ("DSC"), well known to persons skilled in the art. The Tg measurements of the sulfopolyesters of the present invention are conducted using a "dry polymer", that is, a polymer sample in which adventitious or absorbed water is driven off by heating to polymer to a temperature of about 200.degree. C. and allowing the sample to return to room temperature. Typically, the sulfopolyester is dried in the DSC apparatus by conducting a first thermal scan in which the sample is heated to a temperature above the water vaporization temperature, holding the sample at that temperature until the vaporization of the water absorbed in the polymer is complete (as indicated by an a large, broad endotherm), cooling the sample to room temperature, and then conducting a second thermal scan to obtain the Tg measurement. Further examples of glass transition temperatures exhibited by the sulfopolyester are at least 30.degree. C., at least 35.degree. C., at least 40.degree. C., at least 50.degree. C., at least 60.degree. C., at least 65.degree. C., at least 80.degree. C., and at least 90.degree. C. Although other Tg's are possible, typical glass transition temperatures of the dry sulfopolyesters our invention are about 30.degree. C., about 48.degree. C., about 55.degree. C., about 65.degree. C., about 70.degree. C., about 75.degree. C., about 85.degree. C., and about 90.degree. C.

Our invention also provides sulfopolyesters which comprise: (i) about 50 to about 96 mole % of one or more residues of isophthalic acid or terephthalic acid, based on the total acid residues; (ii) about 4 to about 30 mole %, based on the total acid residues, of a residue of sodiosulfoisophthalic acid; (iii) one or more diol residues wherein at least 25 mole %, based on the total diol residues, is a poly(ethylene glycol) having a structure H—(OCH.sub.2-CH.sub.2).sub.n-OH wherein n is an integer in the range of 2 to about 500; (iv) 0 to about 20 mole %, based on the total repeating units, of residues of a branching monomer having 3 or more functional groups wherein the functional groups are hydroxyl, carboxyl, or a combination thereof.

The sulfopolyester may contain other concentrations of isophthalic acid residues, for example, about 60 to about 95 mole %, and about 75 to about 95 mole %. Further examples of isophthalic acid residue concentrations ranges are about 70 to about 85 mole %, about 85 to about 95 mole % and about 90 to about 95 mole %. The sulfopolyester also may comprise about 25 to about 95 mole % of the residues of diethylene glycol. Further examples of diethylene glycol residue concentration ranges include about 50 to about 95 mole %, about 70 to about 95 mole %, and about 75 to about 95 mole %. The sulfopolyester also may include the residues of ethylene glycol and/or 1,4-cyclohexanedimethanol, abbreviated herein as "CHDM". Typical concentration ranges of CHDM residues are about 10 to about 75 mole %, about 25 to about 65 mole %, and about 40 to about 60 mole %. Typical concentration ranges of ethylene glycol residues are are about 10 to about 75 mole %, about 25 to about 65 mole %, and about 40 to about 60 mole %. In another embodiment, the sulfopolyester comprises is about 75 to about 96 mole % of the residues of isophthalic acid and about 25 to about 95 mole % of the residues of diethylene glycol.

The sulfopolyesters of the present invention are readily prepared from the appropriate dicarboxylic acids, esters, anhydrides, or salts, sulfomonomer, and the appropriate diol or diol mixtures using typical polycondensation reaction conditions. They may be made by continuous, semi-continuous, and batch modes of operation and may utilize a variety of reactor types. Examples of suitable reactor types include, but are not limited to, stirred tank, continuous stirred tank, slurry, tubular, wiped-film, falling film, or extrusion reactors. The term "continuous" as used herein means a process wherein reactants are introduced and products withdrawn simultaneously in an uninterrupted manner. By "continuous" it is meant that the process is substantially or completely continuous in operation and is to be contrasted with a "batch" process. "Continuous" is not meant in any way to prohibit normal interruptions in the continuity of the process due to, for example, start-up, reactor maintenance, or scheduled shut down periods. The term "batch" process as used herein means a process wherein all the reactants are added to the reactor and then processed according to a predetermined course of reaction during which no material is fed or removed into the reactor. The term "semicontinuous" means a process where some of the reactants are charged at the beginning of the process and the remaining reactants are fed continuously as the reaction progresses.

Alternatively, a semicontinuous process may also include a process similar to a batch process in which all the reactants are added at the beginning of the process except that one or more of the products are removed continuously as the reaction progresses. The process is operated advantageously as a continuous process for economic reasons and to produce superior coloration of the polymer as the sulfopolyester may deteriorate in appearance if allowed to reside in a reactor at an elevated temperature for too long a duration.

The sulfopolyesters of the present invention are prepared by procedures known to persons skilled in the art. The sulfomonomer is most often added directly to the reaction mixture from which the polymer is made, although other processes are known and may also be employed, for example, as described in U.S. Pat. Nos. 3,018,272, 3,075,952, and 3,033,822. The reaction of the sulfomonomer, diol component and the dicarboxylic acid component may be carried out using conventional polyester polymerization conditions. For example, when preparing the sulfopolyesters by means of an ester interchange reaction, i.e., from the ester form of the dicarboxylic acid components, the reaction process may comprise two steps. In the first step, the diol component and the dicarboxylic acid component, such as, for example, dimethyl isophthalate, are reacted at elevated temperatures, typically, about 150.degree. C. to about 250.degree. C. for about 0.5 to about 8 hours at pressures ranging from about 0.0 kPa gauge to about 414 kPa gauge (60 pounds per square inch, "psig"). Preferably, the temperature for the ester interchange reaction ranges from about 180.degree. C. to about 230.degree. C. for about 1 to about 4 hours while the preferred pressure ranges from about 103 kPa gauge (15 psig) to about 276 kPa gauge (40 psig). Thereafter, the reaction product is heated under higher temperatures and under reduced pressure to form sulfopolyester with the elimination of diol, which is readily volatilized under these conditions and removed from the system. This second step, or polycondensation step, is continued under higher vacuum and a temperature which generally ranges from about 230.degree. C. to about 350.degree. C., preferably about 250.degree. C. to about 310.degree. C. and most preferably about 260.degree. C. to about 290.degree. C. for about 0.1 to about 6 hours, or preferably, for about 0.2 to about 2 hours, until a polymer having the desired degree of polymerization, as determined by inherent viscosity, is obtained. The polycondensation step may be conducted under reduced pressure which ranges from about 53 kPa (400 torr) to about 0.013 kPa (0.1 torr). Stirring or appropriate conditions are used in both stages to ensure adequate heat transfer and surface renewal of the reaction mixture. The reactions of both stages are facilitated by appropriate catalysts such as, for example, alkoxy titanium compounds, alkali metal hydroxides and alcoholates, salts of organic carboxylic acids, alkyl tin compounds, metal oxides, and the like. A three-stage manufacturing procedure, similar to that described in U.S. Pat. No. 5,290,631, may also be used, particularly when a mixed monomer feed of acids and esters is employed.

To ensure that the reaction of the diol component and dicarboxylic acid component by an ester interchange reaction mechanism is driven to completion, it is preferred to employ about 1.05 to about 2.5 moles of diol component to one mole dicarboxylic acid component. Persons of skill in the art will understand, however, that the ratio of diol component to dicarboxylic acid component is generally determined by the design of the reactor in which the reaction process occurs.

In the preparation of sulfopolyester by direct esterification, i.e., from the acid form of the dicarboxylic acid component, sulfopolyesters are produced by reacting the dicarboxylic acid or a mixture of dicarboxylic acids with the diol component or a mixture of diol components. The reaction is conducted at a pressure of from about 7 kPa gauge (1 psig) to about 1379 kPa gauge (200 psig), preferably less than 689 kPa (100 psig) to produce a low molecular weight, linear or branched sulfopolyester product having an average degree of polymerization of from about 1.4 to about 10. The temperatures employed during the direct esterification reaction typically range from about 180.degree. C. to about 280.degree. C., more preferably ranging from about 220.degree. C. to about 270.degree. C. This low molecular weight polymer may then be polymerized by a polycondensation reaction.

The amount of thermoplastic sulfopolyester resin is generally from about 0.25 to about 3.00 weight % on a dry basis, based on the weight of the dried paper. For example in one embodiment the amount of sulfopolyester is from about 0.25-3.00 weight percent, 0.25-2.00 weight percent, or 0.25-1.50 weight percent. In another embodiment the amount of thermoplastic sulfopolyester can be about 0.05 weight % on a dry basis, or about 0.1 weight % or about 0.2 weight %. Typically the ratio of thermoplastic sulfopolyester resin to cationic strength additive is about 5:1 to about 1:5. In one embodiment the ratio of f sulfopolyester to cationic strength additive is about 1:1.

The Repulping Process

The repulping process may be carried out using any conventional method. Typically, the process of repulping the paper to obtain recycled pulp fibers can be carried out by any mechanical action that disperses dry pulp fibers into an aqueous pulp fiber suspension. Conditions for repulping, as well as equipment commercially used, are discussed in "Handbook for Pulp & Paper Technologists, Second Edition" by G. A. Smook, Angus Wilde Publications, 1992, pp 194-195 and 211-212, which reference is incorporated herein by reference in its entirety.

It was found that paper prepared by the process of the present invention can be repulped in substantially less time than is required to repulp the same paper at about the same level of wet-strength.

The paper products of the present invention are suitable for use in the following areas: paper towels; napkins; facial tissue; liquid packaging board (milk carton, juice carton); poultry boxes; produce boxes; carrierboard; butchers wrap; bleached bag; poster board; table cloth; wallboard tape; currency paper; map paper; tea bag; corrugating medium; paper plates; molded products (egg cartons); laminating grades; flooring felt; coffee filter; bread wrap; multiwall bag; shingle wrap, etc.

The recycled pulp fibers prepared by the repulping process of the present invention can be used to make paper by conventional paper making processes, which comprise providing an aqueous suspension of the recycled pulp fibers and then sheeting and drying the aqueous suspension to obtain paper.

The invention has been described in detail with particular reference to preferred embodiments thereof, but it will be understood that variations and modifications can be effected within the spirit and scope of the invention.

This invention can be further illustrated by the following examples of potential embodiments thereof, although it will be understood that these examples are included merely for the purposes of illustration and are not intended to limit the scope of the invention unless otherwise specifically indicated. Parts and percentages mean parts by weight and percentages by weight, unless otherwise specified.

EXAMPLES

The examples were conducted using EastONE S85030 sulfopolyester dispersion to determine the effect of its addition on wet strength, dry strength and repulpability of paper in comparison to commercially available additives such as Kymene® and Hercobond® products from Hercules Incorporated, Wilmington, Del.

Preparation of Sulfopolyester and Polyamide Epichlorohydrin (PAE) Solutions:

A 3 wt % solution of a sulfopolyester was prepared as follows. 500 grams of distilled water was placed into a beaker heated to approximately 88.degrees. C. on a hot plate. 15.5 grams of sulfopolyester pellets were added and continually stirred while maintaining a temperature of 88.degrees. C. F for 10-15 minutes or until all of the sulfopolyester had dissolved. The mixture was cooled and distilled water was added to achieve a total solution weight of 515.5 grams.

A 3 wt % solution of a PAE solution was prepared as follows. 500 grams of distilled water was placed into a beaker. 160 grams of a 12.5 wt % solution of a commercially available PAE solution was added to the beaker and stirred.

Coating Procedure:

Each of the 3 wt % solutions was diluted, respectively, using distilled water such that when 3 ml of the solution was applied to the paper sheet, the target add-on concentration of 0.5 wt % was achieved.

3 drops of food coloring were added to each of the solutions as a visual aid to ensure uniform coverage of the solutions on the paper. An 8½"×11" sheet of Lydall paper was placed on top of a larger piece of release paper. Lydall 18-½# Manning 514 saturating paper sheets weighing 1.87±0.01 grams were used. The release paper was parchment paper laminated to aluminum foil.

A control was prepared as follows. 5 ml of distilled water was added to the paper sheet using a 5 ml volumetric pipette. The water was gently rolled into the sheet using a 2 inch rubber hand roller. The paper sheet, with the release sheet attached, was dried for 5 minutes in a 93.degree. C. convection oven. The dried sheet was stored for 4 days under a 2 pound flat weight. This sample is referred to as the Control.

A sample containing 0.5 wt % PAE resin was prepared as follows. 5 ml of distilled water was added to the paper sheet using a 5 ml volumetric pipette. The water was gently rolled into the sheet using a hand roller. 3 ml of the diluted PAE solution was added with a 3 ml syringe to the pre-wetted paper. The solution was gently rolled into the sheet using a hand roller until uniform color was achieved. The paper sheet, with the release sheet attached, was dried for 5 minutes in a 93.degree. C. convection oven. The dried sheet was stored for 4 days under a 2 pound flat weight. This sample is referred to as Sample 1.

A sample containing 0.5 wt % sulfopolyester resin was prepared as follows. 5 ml of distilled water was added to the paper sheet using a 5 ml volumetric pipette. The water was gently rolled into the sheet using a hand roller. 3 ml of the diluted sulfopolyester solution was added with a 3 ml syringe to the pre-wetted paper. The solution was gently rolled into the sheet using a hand roller until uniform color was achieved. The paper sheet, with the release sheet attached, was dried for 5 minutes in a 93.degree. C. convection oven. The dried sheet was stored for 4 days under a 2 pound flat weight. This sample is referred to as Sample 2.

An example of the present invention containing 0.25 wt % PAE and 0.25 wt % sulfopolyester was prepared as follows. 5 ml of distilled water was added to the paper sheet using a 5 ml volumetric pipette. The water was gently rolled into the sheet using a hand roller. 3 ml of the diluted PAE solution was added with a 3 ml syringe to the pre-wetted paper. The solution was gently rolled into the sheet using a hand roller until uniform color was achieved. The sheet was allowed to sit for 2 minutes. 3 ml of the diluted sulfopolyester solution was subsequently added to the paper with a 3 ml syringe. The sulfopolyester solution was gently hand rolled into the paper. The paper sheet, with the release sheet attached, was dried for 5 minutes in a 93.degree. C. convection oven. The dried sheet was stored for 4 days under a 2 pound flat weight. This sample is referred to as Sample 3.

The control and Samples 1, 2 and 3 were evaluated for dry strength and wet strength using the following TAPPI test methods:

- T494-om-88: Tensile Breaking Properties of Paper and Paperboard (Using Constant Rate of Elongation Apparatus)
- T456-om-87: Tensile Breaking Strength of Water-Saturated Paper and Paperboard ("Wet Tensile Strength")

The repulpability of the paper samples was determined as follows. A brass hydropulper manufactured by Hermann Manufacturing Company was used for testing. The hydropulper was a 2 liter vessel with a 3000 rpm, ¾ horsepower tri-rotor. The hydropulper had a diameter of 6 inches and a height of 10 inches.

Samples were cut into two 1 inch squares. A 2 liter sample of water was maintained at 20.degrees. C. and poured into the hydropulper. The counter was set to zero and both samples were placed into the hydropulper. The samples were pulped at intervals of 500 revolutions. After each of the 500 revolutions, the hydropulper was temporarily stopped and a fluorescent inspection light was held over the basin to determine whether or not the samples had been fully pulped. The number of sets per 500 revolutions was recorded. After 15,000 revolutions, samples were considered not repulpable and testing was discontinued. The test results are shown below in Table 1.

TABLE 1

Test results for control, Sample 1, Sample and Sample 3.

| | Dry Tensile Strength (g/15 mm) | Wet Tensile Strength (g/15 mm) | Repulpability (Revolutions to Repulp) |
|---|---|---|---|
| Control | 3900 | 179 | 500 |
| 0.5 wt % PAE (Sample 1) | 4200 | 408 | 15,000* |
| 0.5 wt % Sulfopolyester (Sample 2) | 4600 | 250 | 3500 |
| 0.25 wt % PAE + 0.25 wt % Sulfopolyester (Sample 3) | 4100 | 469 | 6000 |

*Note: After 15,000 revolutions, the sample was considered not repulpable and testing was discontinued.

That which is claimed is:

1. A repulpable paper product comprising: papermaking fibers; a cationic strength additive; and a thermoplastic sulfopolyester resin, wherein the papermaking fibers are selected from woody fibers, softwood fibers, hardwood fibers, non-woody fibers, synthetic polymeric fibers, recycled fibers, glass fibers, or combinations thereof, wherein the synthetic polymeric fibers are greater than 50% of the total papermaking fiber, wherein said synthetic polymeric fibers have a mean fiber diameter of less than 5 microns.

2. The repulpable paper products of claim 1 wherein the sulfopolyester resin comprises (i) residues of one or more dicarboxylic acids;

(ii) about 4 to about 40 mole %, based on the total repeating units, of residues of at least one sulfomonomer having 2 functional groups and one or more sulfonate groups attached to an aromatic or cycloaliphatic ring wherein said functional groups are hydroxyl, carboxyl, or a combination thereof;

(iii) one or more diol residues wherein at least 25 mole %, based on the total diol residues, is a poly(ethylene glycol) having a structure $H—(OCH_2—CH_2)_n—OH$ wherein n is an integer in the range of 2 to about 500; and (iv) 0 to about 25 mole %, based on the total repeating units, of residues of a branching monomer having 3 or more functional groups wherein said functional groups are hydroxyl, carboxyl, or a combination thereof.

3. The repulpable paper products of claim 2 wherein the dicarboxylic acids are selected from aliphatic diacids, cycloaliphatic dicarboxylic acids, aromatic dicarboxylic acids, and combinations thereof.

4. The repulpable paper products of claim 3 wherein the dicarboxylic acids are selected from succinic, glutaric, adipic, azelaic, sebacic, fumaric, maleic, itaconic, 1,3-cyclohexane dicarboxylic, 1,4-cyclohexanedicarboxylic, diglycolic, 2,5-norbornanedicarboxylic, phthalic, terephthallc, 1,4-naphthalenedlcarboxylic, 2,5-naphthalenedicarboxylic, 2,6-naphthalenedicarboxylic, 2,7-naphthalenedicarboxylic, diphenic, 4,4'-oxydibenzoic, 4,4'-sulfonyldibenzoic, isophthalic, and combinations thereof.

5. The repulpable paper products of claim 2 wherein the sulfomonomer is a metal sulfonate salt of a sulfophthalic acid, sulfoterephthalic acid, sulfoisophthalic acid, or combinations thereof.

6. The repulpable paper products of claim 2 wherein the diol residues are selected from ethylene glycol, diethylene glycol, triethylene glycol, poly(ethylene) glycols, 1,3-propanediol, 2,4-dimethyl-2-ethylhexane-1,3-diol, 2,2-dimethyl-1,3-propanediol, 2-ethyl-2-butyl-1,3-propanediol, 2-ethyl-2-isobutyl-1,3-propanediol, 1,3-butanedlol, 1,4-butanediol, 1,5-pentanediol, 1,6-hexanediol, 2,2,4-trimethyl-1,6-hexanediol, thiodiethanol, 1,2-cyclohexanedimethanol, 1,3-cyclohexanedimethanol, 1,4-cyclohexanedimethanol, 2,2,4,4-tetramethyl-1,3-cyclobutanediol, p-xylylenediol, and combinations thereof.

7. The repulpable paper products of claim 2 wherein the branching monomer is 1,1,1-trimethylol propane, 1,1,1-trimethylolethane, glycerin, pentaerythritol, erythritol, threitol, dipentaerythritol, sorbitol, trimellitic anhydride, pyromellitic dianhydride, dimethylol propionic acid, or combinations thereof.

8. The repulpable paper products of claim 1 wherein the cationic strength additive is selected from polyacrylamide resins, polyamide epihalohydrin resins, polyamine epihalohydrin resins, polyamidoamine epichalohydrin resins, polyalkyleneimine resins, urea-formaldehyde resins, melamine-formaldehyde resins, cationic polysaccharides or combinations thereof.

9. The repulpable paper products of claim 8 wherein the cationic strength additive is selected from cationic glyoxylated polyacrylamide resins or polyamidoamine epichlorohydrin resins.

10. The repulpable paper products according to claim 1 wherein the synthetic polymer fibers are greater than 70% of the total papermaking fiber.

11. The repulpable paper products of claim 1 wherein the amount of cationic strength additive is about 0.25 weight % to about 3 weight % on a dry basis and the amount of thermoplastic sulfopolyester resin is about 0.25 to about 3.00 weight %, on a dry basis relative to the weight of the dried paper product.

12. The repulpable paper products of claim 1 wherein the amount of cationic strength additive is about 0.25 weight % to about 2 weight % on a dry basis and the amount of thermoplastic sulfopolyester resin is about 0.25 to about 2 weight %, on a dry basis relative to the weight of the dried paper product.

13. The repulpable paper product of claim 1 wherein the amounts of cationic strength additive is about 0.25 weight to about 1.5 weight % on a dry basis and the amount of thermoplastic sulfopolyester resin is about 0.25 to about 1.5 weight %, on a dry basis relative to the weight of the dried paper product.

14. The repulpable paper products of claim 1 wherein the ratio of thermoplastic sulfopolyester resin to cationic strength additive is about 5:1 to about 1:5.

15. The repulpable paper products of claim 1 wherein the ratio of sulfopolyester to cationic strength additive is about 1:1.

16. A method of improving the wet-strength of cellulosic paper comprising adding a cationic strength additive and a sulfopolyester thermoplastic resin to papermaking fibers during the papermaking process;

wherein the papermaking fibers are selected from woody fibers, softwood fibers, hardwood fibers, non-woody fibers, synthetic polymeric fibers, recycled fibers, glass fibers, or combinations thereof, wherein the synthetic polymeric fibers are greater than 50% of the total papermaking fiber, wherein said synthetic polymeric fibers have a mean fiber diameter of less than 5 microns, and wherein the paper comprises said papermaking fibers, said cationic strength additive and said sulfopolyester thermoplastic resin.

17. The method of claim 16 wherein the cationic strength additive and sulfopolyester thermoplastic resin are added to an aqueous slurry of papermaking fibers during the papermaking process.

18. The method of claim 16 wherein said cationic strength additive is added to an aqueous slurry of papermaking fibers and the sulfopolyester thermoplastic resin is applied onto a paper web resulting from the dewatering of said papermaking fibers.

19. The method of claim 18 wherein the thermoplastic sulfopolyester resin is applied to the paper web by spray application.

20. The method of claim 16 wherein the resulting paper products exhibit enhanced repulpability.

21. A paper product comprising:

papermaking fibers consisting of one or more of woody fibers, softwood fibers, hardwood fibers, non-woody fibers, synthetic polymeric fibers, recycled fibers, or glass fibers;

cationic strength additives consisting of one or more of polyacrylamide resins, polyamide epihalohydrin resins, polyamine epihalohydrin resins, polyamidoamine epichalohydrin resins, polyalkyleneimine resins, urea-formaldehyde resins, melamine-formaldehyde resins, or cationic polysaccharides; and thermoplastic sulfopolyester resins comprising (i) residues of one or more dicarboxylic acids;

(ii) about 4 to about 40 mole %, based on the total repeating units, of residues of at least one sulfomonomer having 2 functional groups and one or more sulfonate groups attached to an aromatic or cycloaliphatic ring wherein said functional groups are hydroxyl, carboxyl, or a combination thereof;

(iii) one or more diol residues wherein at least 25 mole %, based on the total diol residues, is a poly (ethylene glycol) having a structure $H—(OCH_2—CH_2)_n—OH$ wherein n is an integer in the range of 2 to about 500; and (iv) 0 to about 25 mole %, based on the total repeating units, of residues of a branching monomer having 3 or more functional groups wherein said functional groups are hydroxyl, carboxyl, or a combination thereof, wherein the synthetic polymeric fibers are greater than 50% of the total papermaking fiber, wherein said synthetic polymeric fibers have a mean fiber diameter of less than 5 microns.

* * * * *